US012753537B2

(12) United States Patent
Abdulsalam et al.

(10) Patent No.: US 12,753,537 B2
(45) Date of Patent: Oct. 6, 2026

(54) SYSTEM AND METHOD FOR WIG MANUFACTURE

(71) Applicant: Renatural Inc., New York, NY (US)

(72) Inventors: Aasiyah Abdulsalam, New York, NY (US); Kristie D'Ambrosio-Correll, Port Washington, NY (US); Eric D'Ambrosio-Correll, Port Washington, NY (US)

(73) Assignee: Renatural Inc., New York, NY (US)

( * ) Notice: Subject to any disclaimer, the term of this patent is extended or adjusted under 35 U.S.C. 154(b) by 77 days.

(21) Appl. No.: 18/821,084

(22) Filed: Aug. 30, 2024

(65) Prior Publication Data

US 2025/0072541 A1 Mar. 6, 2025

Related U.S. Application Data

(60) Provisional application No. 63/536,261, filed on Sep. 1, 2023.

(51) Int. Cl.
*D05C 15/02* (2006.01)
*A41G 3/00* (2006.01)

(52) U.S. Cl.
CPC ..... *D05C 15/02* (2013.01); *A41G 3/0075* (2013.01)

(58) Field of Classification Search
CPC . D05C 15/02; D05C 3/02; D05C 9/16; D05C 17/00; A41G 3/0066; A41G 3/0075
See application file for complete search history.

(56) References Cited

U.S. PATENT DOCUMENTS 12,538,954 B2 * 2/2026 Iimura ..... A41G 3/0075
2001/0035190 A1 * 11/2001 Fukuyama ..... A41G 3/0075 132/53
2004/0250829 A1 * 12/2004 Fukuyama ..... A41G 3/0075 132/56
2021/0145100 A1 * 5/2021 Obama ..... D05C 15/02
(Continued)

FOREIGN PATENT DOCUMENTS

CN 1558728 A * 12/2004 ..... A41G 3/0075
CN 201000680 Y 1/2008
CN 103859673 B 12/2016
(Continued)

OTHER PUBLICATIONS

Translation of CN-1558728-A.*
(Continued)

*Primary Examiner* — Danny Worrell
(74) *Attorney, Agent, or Firm* — Stephen J. Kenny; Nicole A. Bustos-Pomerantz; Foley Hoag LLP

(57) ABSTRACT

A system for the manufacture of a wig, the system including a frame having a rotating arm spanning in a first direction, a head form coupled to the rotating arm, the head form having an convex arcuate surface, a shuttle slidingly coupled to the frame, the shuttle having an arcuate edge, a plurality of funnels disposed about the arcuate edge of the shuttle, the funnels having an opening disposed therethrough, the plurality of funnels configured to contact the head form, a plurality of cartridges coupled to the plurality of funnels, an injector needle coupled to an injector arm, the injector arm configured to position the injector needle perpendicularly over the convex arcuate portion of the head form.

14 Claims, 24 Drawing Sheets

(56) References Cited

U.S. PATENT DOCUMENTS

2023/0301383 A1* 9/2023 Iimura ..... A41G 3/0075

FOREIGN PATENT DOCUMENTS

| | | | |
|---|---|---|---|
| CN | 108126350 | A | 6/2018 |
| CN | 219165753 | U | 6/2023 |
| WO | WO-2023/108345 | A1 | 6/2023 |

OTHER PUBLICATIONS

International Search Report and Written Opinion for International Application No. PCT/US24/44708 dated Nov. 15, 2024.

* cited by examiner

SYSTEM AND METHOD FOR WIG MANUFACTURE

CROSS-REFERENCE TO RELATED APPLICATIONS

This application claims the benefit of priority to U.S. Provisional App. No. 63/536,261, filed on Sep. 1, 2023. The entire contents of which are hereby incorporated by reference.

BACKGROUND OF THE DISCLOSED SUBJECT MATTER

Field of the Disclosed Subject Matter

The disclosed subject matter relates to a system and method for wig manufacture. Particularly, the present disclosed subject matter is directed to a system and method for automated wig manufacture using a rotating head form and shuttle having hair cartridges.

Description of Related Art

Wigs worn today cause skin infections, tension headaches and traction alopecia. They're also time consuming, unrealistic, and expensive.

Customers are wasting time, money and are dangerously impacting their health by wearing wigs made from nylon, lace, polyester, elastic bands, and hair from unverified and often unethical sources.

1. Security: The anxiety of your wig falling off or shifting is a pervasive phenomenon. It makes it difficult to partake in numerous activities. Adjusting your wig and the security of your wig is something wig wearers cannot go a few hours without thinking about. It's restrictive and limiting for women who desire the flexibility, ease, and necessity of wigs. Nothing on the market offers a safe, comfortable, sanitary, easy to apply, strong and prolonged security for wig wearers.
2. Realism: Wigs often end up looking unrealistic (especially with prolonged use) largely because of the ineffective attachment methods. Combs and clips can make the wigs look boxy and ill adjusted, sticky glues/gels leave messy and shiny residue and quickly causes visible bacteria build up.
3. Maintenance: Maintaining a wig can be incredibly tedious. Sticky glues/gels require frequent cleaning, and the application process takes at least 20 minutes. A lot of customers opt to go to a hairstylist and that can be a frequent recurring expense.
4. Discomfort: Current wig attachment methods are uncomfortable. Too tight, too rigid, they pull on hair and irritate the scalp. Customers often pull out their own hair while applying and removing their wigs. Combs, clips, glues/gels, elastic bands, and wig grips all lead to traction alopecia over time due to the excessive pulling and snagging of hair.

Overall, there is a huge cost benefit analysis when it comes to wearing a wig. Lace wigs can offer increase realism but require the use of harmful glues. Combs, clips, wig grips and elastic bands offer easy application but can be painful and offer low security. Glues and sticky gels offer high security but are time intensive and expensive. All solutions negatively impact the hairline and hair growth overtime.

Therefore, there is a need for a system and method for wig manufacture.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a system for the manufacture of a wig, the system including a frame having a rotating arm spanning from a first side of the frame to a second side of the frame in a first direction, a head form coupled to the rotating arm, the head form having a convex arcuate surface, a shuttle slidingly coupled to the frame, the shuttle configured to slide in a second direction, the second direction being perpendicular to the first direction, the shuttle having an arcuate edge corresponding to the convex arcuate portion of the head form, a plurality of funnels disposed about the arcuate edge of the shuttle, the funnels having an opening disposed therethrough, the plurality of funnels configured to contact the convex arcuate surface of the head form, a plurality of cartridges coupled to the plurality of funnels, and an injector needle coupled to an injector arm, the injector arm configured to position the injector needle perpendicularly over the convex arcuate portion of the head form.

The disclosed subject matter also includes a method for manufacturing a wig, the method including coupling a base layer and a cap over a head form, the head form coupled to a rotating arm spanning along a first direction, loading hair into a plurality of cartridges, the plurality of cartridges coupled to a shuttle configured to slide from a proximal end to a distal end along a track extending in a second direction perpendicular to the first direction, rotating the rotating arm to orient the head form to a target location, advancing the shuttle along the track from the proximal end to the distal end, gripping the head form with the shuttle, the shuttle configured to locate the hair onto a target location of the head form and coupling the hair to the target location via an injector needle.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

BRIEF DESCRIPTION OF THE DRAWINGS

A detailed description of various aspects, features, and embodiments of the subject matter described herein is provided with reference to the accompanying drawings, which are briefly described below. The drawings are illustrative and are not necessarily drawn to scale, with some components and features being exaggerated for clarity. The drawings illustrate various aspects and features of the present subject matter and may illustrate one or more embodiment(s) or example(s) of the present subject matter in whole or in part.

DETAILED DESCRIPTION OF AN EXEMPLARY EMBODIMENT

Reference will now be made in detail to exemplary embodiments of the disclosed subject matter, an example of which is illustrated in the accompanying drawings. The method and corresponding steps of the disclosed subject matter will be described in conjunction with the detailed description of the system.

Figure 1A:
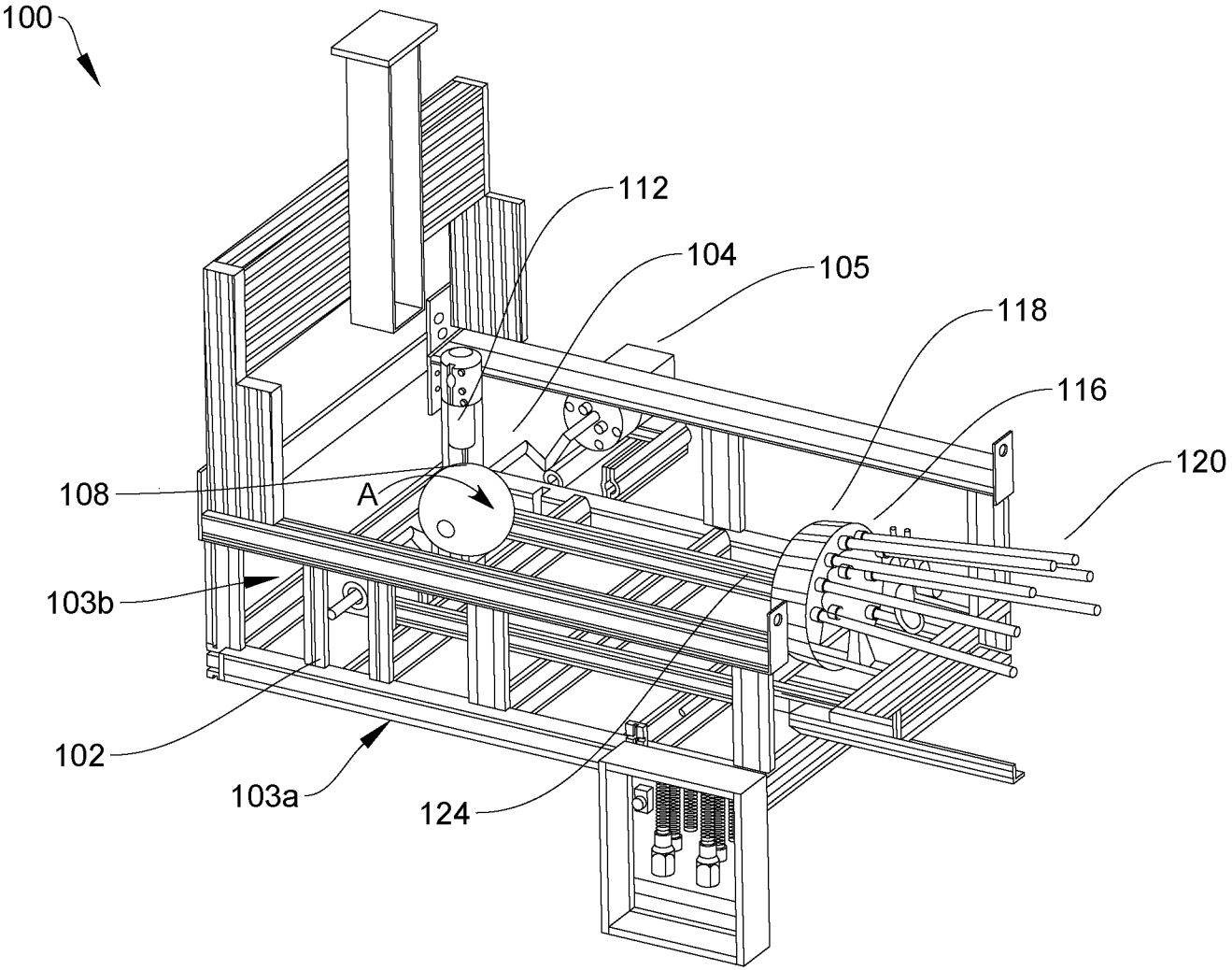
FIGS. 1A-1E are schematics representation of the system for wig manufacture in accordance with the disclosed subject matter.
Figure 1B:
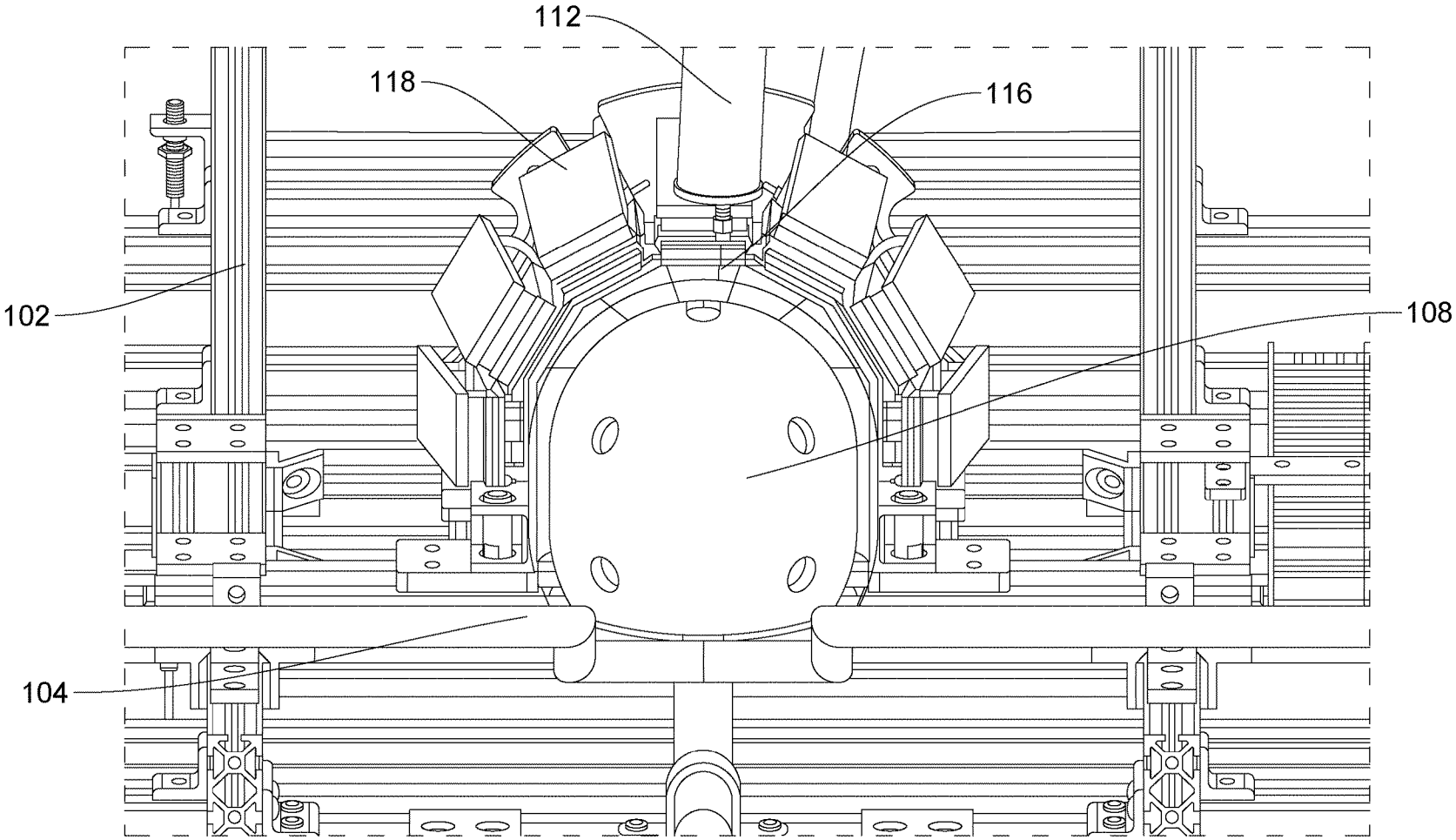
Figure 1C:
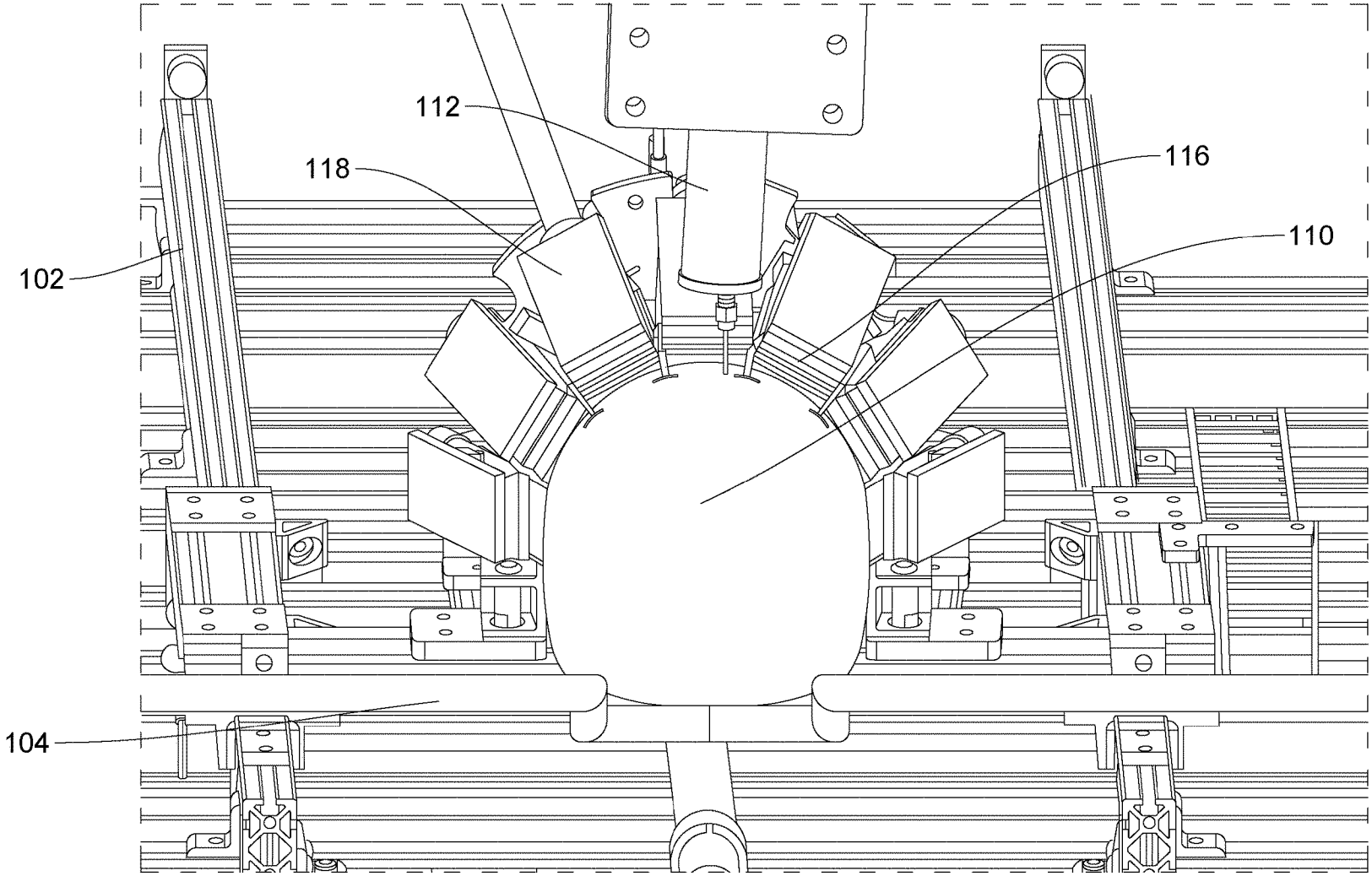
Figure 1D:
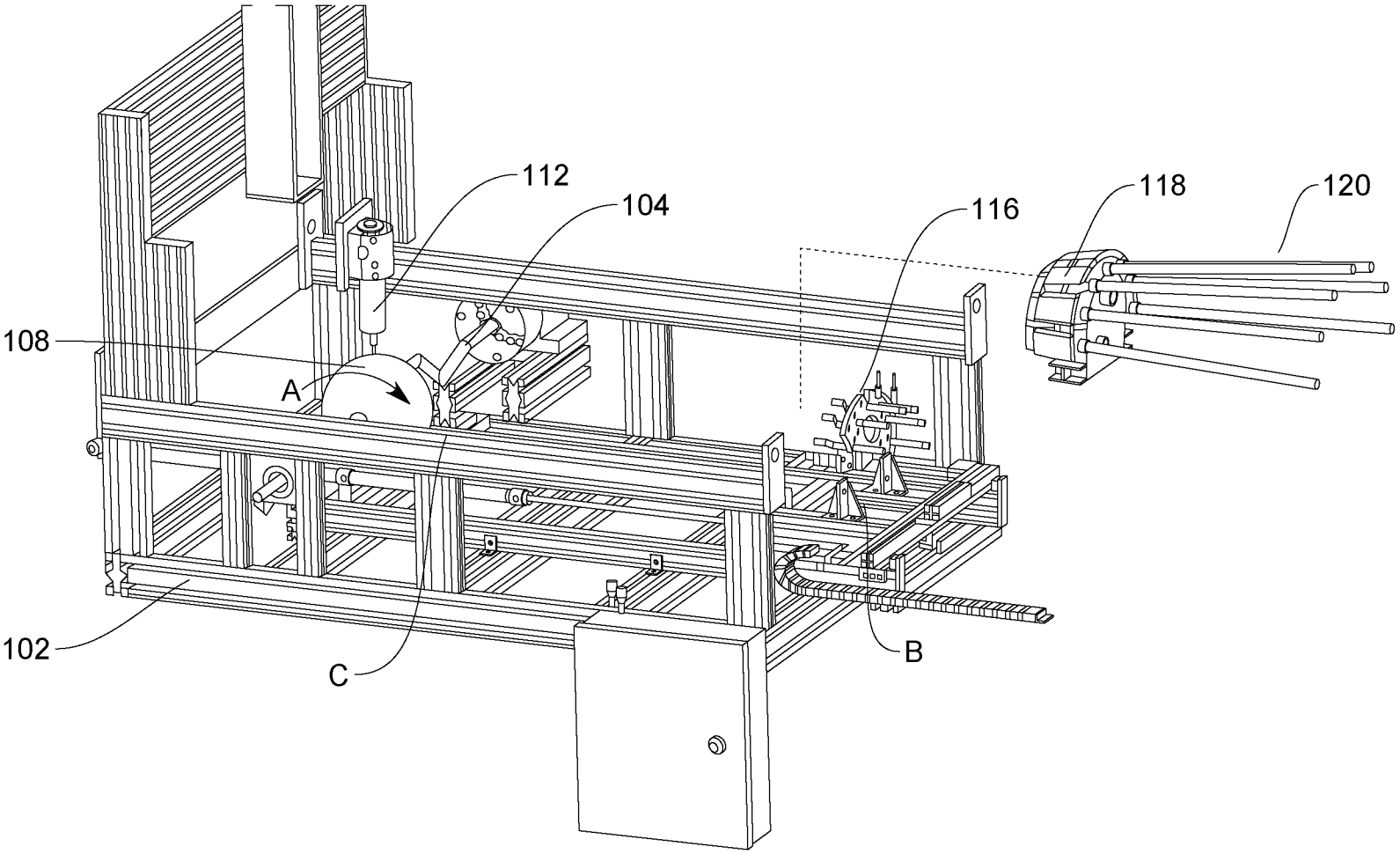
Figure 1E:
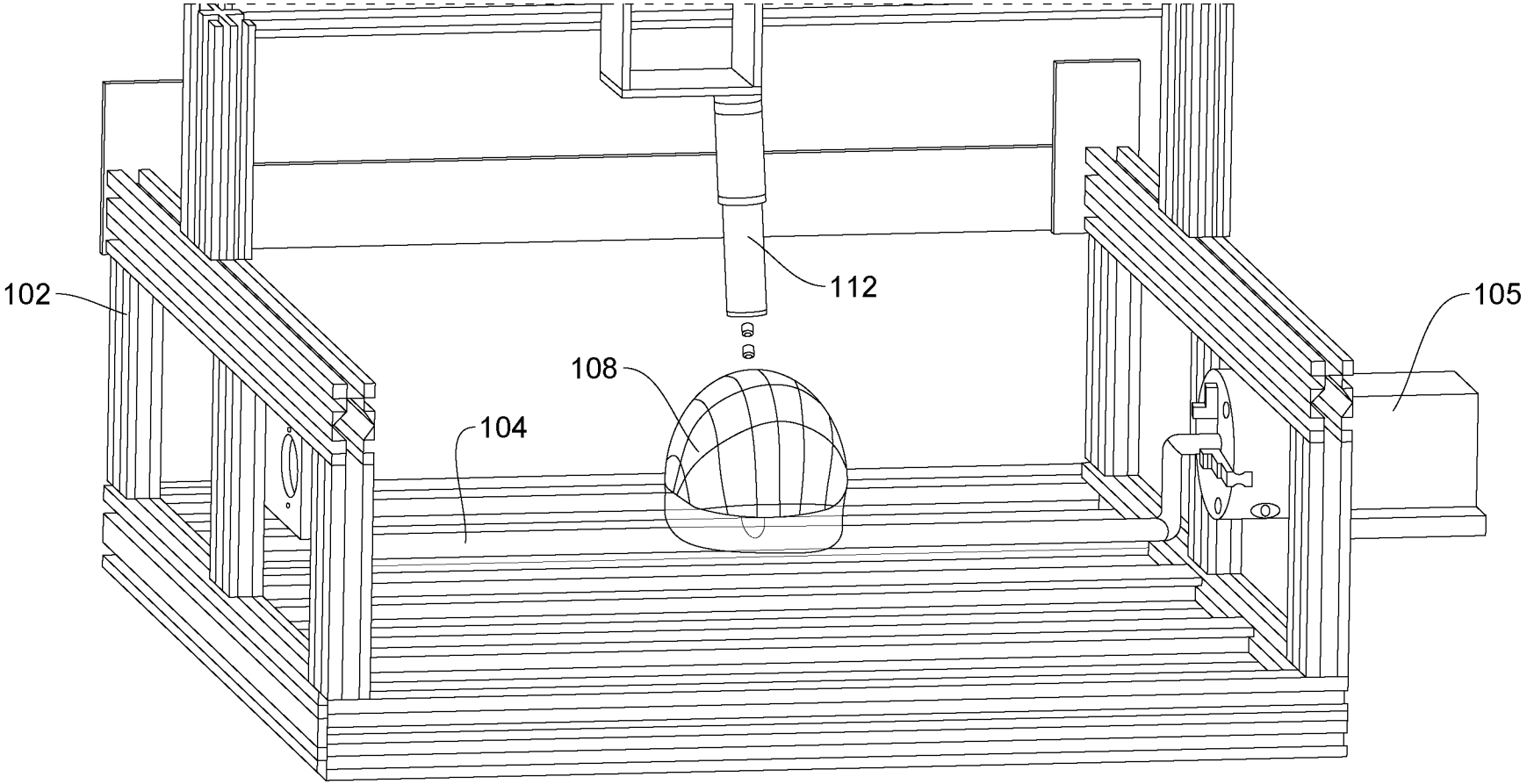

The methods and systems presented herein may be used for wig manufacture. The disclosed subject matter is particularly suited for automated wig manufacture using a rotating head form and sliding shuttle with hair cartridges. For purpose of explanation and illustration, and not limitation, an exemplary embodiment of the system in accordance with the disclosed subject matter is shown in FIG. 1A and is designated generally by reference character 100. Similar reference numerals (differentiated by the leading numeral) may be provided among the various views and Figures presented herein to denote functionally corresponding, but not necessarily identical structures.

The herein disclosed system 100 may be utilized for automated or partially automated manufacture of wigs. A head form having the approximate shape of a portion of a human head on which hair would grow may be placed on a rotating arm that serves to orient the head toward a shuttle that is loaded with bundles of hair. The head form is covered by a base layer that is configured to be pierced by one or more needles. The head form and the base layer are covered by a cap that will serve as the cap of the wig when placed on a human head. The cap and the base layer are configured to be punctured by a needle, wherein the base layer acts as a backing to the cap, so the hair may be injected all the way through the cap. The shuttle may have hair loaded inside, with the ends of the hair to be injected exposed, so when the shuttle is brought into contact with the head form, the ends of the hair are placed on a target location of the cap (with the base layer and the head form underneath) and are ready to be injected into the cap and the base layer on the head form. The location of the ends of the hair on the target location of the cap will be the root of the injected hair.

The shuttle may be configured to move to and from the head form with the base layer and the cap. The shuttle may be reloaded with hair at a reload location, which may be a proximal end of a track. The shuttle may then be advanced toward the head form once reloaded, with the head form's rotating arm utilized to tilt the head to vary the target location to make sure hair is injected all over the cap in the shape of a believable head of hair. For example, the shuttle may be advanced such that the ends of the hair are located on a target location of the cap, once injected, the shuttle will retreat, the head form will rotate further, orienting a bald portion of the cap, so when the shuttle is advanced again, a new row of hair is injected into the cap.

The system may be configured to inject hair in any amount of steps, rows or patterns. For example, and without limitation, the head form may be tilted to orient the target location toward the shuttle that will correspond to the forehead hairline of the wig. The hair may be injected into the cap to form the hair line, then reloaded into the shuttle at the reload proximal position. The head form may then be tilted to orient the target location corresponding to the nape of the neck toward the shuttle for hair injection. Then the bulk of the hair may be injected between the nape line and the hair line of injected hair, the bulk of the hair corresponding to the rest of the hair of the wig.

After the injection of the hair is complete, after the shuttle is retreated from the head form may be removed from the rotating arm and coupled to a fixture that allows for the removal of the base layer and the newly-injected cap from the head form. In various embodiments, the base layer may be removed with the cap from the head form, then the base layer may be removed from inside the cap.

Referring now to FIG. 1A-1E, a system 100 for wig manufacture is shown in perspective view. System 100 includes a frame 102. Frame 102 may be formed from at least two side rails 103*a* having a proximal end to a distal end defining a rail length therebetween. A pair of side rails 103*a* can be positioned on either side of the apparatus in vertical alignment, as shown in the exemplary embodiment. In various embodiments the side rails are disposed parallel from one another and spaced laterally. In various embodiments, frame 102 includes a plurality of struts 103*b*, equidistantly spaced, and spanning from the side rails perpendicular thereto. In various embodiments, the plurality of struts may be coupled to the side rails perpendicularly. In various embodiments, the plurality of struts may be coupled at an angle to the side rails. In various embodiments, any of the rails and struts shown herein may include channels spanning the length configured to receive one or more bosses or protrusions to adjust the spacing between the rails and struts. In various embodiments, the frame 102 may include a general box shape having parallel and normal connections. In various embodiments, frame 102 may have any planform shapes, including arcuate rails and struts. In various embodiments, frame 102 has an interior space defined by at least the side rails and the outermost struts.

With continued reference to FIG. 1A-1E, system 100 includes a frame 102 having a rotating arm 104 disposed within the interior space of the frame 102 and configured to rotate about an axis that is parallel to the struts 103*b*. Rotating arm 104 may span from the first side rail of the frame to the second side of the frame along a first direction. In various embodiments, the first direction may be the lateral direction parallel to the struts. Rotating arm 104 may have a first end and a second end, defining a length therebetween. In various embodiments, rotating arm 104 may be a linear arm. In various embodiments, rotating arm 104 may be non-linear and include at least one bend, angle or arcuate portion. For example, and without limitation, rotating arm 104 may have a plurality of angles as to provide clearance for any intervening struts or rails as described herein. For example, and without limitation, rotating arm 104 may have generally linear portions at the first end and the second end coupled to the side rails via one or more bearings. Rotating arm 104 may have normal angle bends disposed interior to the outermost linear portions and a parallel center portion connected thereto. In various embodiments, rotating arm 104 may have a protrusion or strut extending therefrom proximate the center of the rotating arm 104. In various embodiments, the center strut of the rotating arm 104 may have one or more slots disposed therein to provide clearance for any rails intervening in the arcuate path rotating arm 104 may rotate in.

With continued reference to FIG. 1A-1E, rotating arm 104 may be coupled to the frame via one or more rotational bearings. For example, and without limitation, frame 102 may include these bearings as integral portions or be coupled thereto. For example, and without limitation, the bearings may be ball bearings, deep groove, self-aligning, angular contact, or thrust ball bearings. For example, and without limitation, the bearings may be roller bearings such as tapered, spherical, cylindrical or needle roller bearings. In various embodiments, the bearings may be movable with respect to the frame such that the rotating arm 104 may be selectively located within frame 102.

Rotating arm 104 may be configured to rotate along an arcuate path within frame 102, the arcuate path radially spaced from an axis parallel to the span of rotating arm 104. In various embodiments, rotating arm 104 may be configured to rotate about an axis defined through each of the bearings disposed at either end. In various embodiments, rotating arm 104 may rotate about said axis, with the strut coupled to the rotating arm 104 tracing an arcuate path disposed at a radius from said axis as shown by path 'A' in FIGS. 1A and 1D.

In various embodiments, rotating arm 104 may be rotated by an actuator 105. In various embodiments, actuator 105 may be disposed at one end of rotating arm 104 and coupled to frame 102 proximate said one end. In various embodiments, actuator 105 may be an electric motor, such as a brushed or brushless electric motor. In various embodiments, actuator 105 may be a stepper motor or servomotor. In various embodiments, actuator 105 may include one or more gearboxes configured to transmit rotational energy to the rotating arm through one or more gears or similar couplings. In various embodiments, actuator 105 may be a worm screw rotating coupled to a gearbox and rotating arm 104. In various embodiments, actuator 105 may be a manual interface configured to be operated by a human or robotic user. For example, and without limitation, actuator 105 may include a handle, wheel or other component configured to be gripped by a hand or effector. In various embodiments, rotating arm 104 may be formed from a portion of a robotic arm, such as a 6-axis robotic arm. In various embodiments, actuator 105 may be configured to be in electrical communication with a controller configured to command the actuator 105 to rotate arm 104 according to one or more automated or manual inputs.

With continued reference to FIG. 1A-1E, system 100 includes a head form 108 releasably coupled to rotating arm 104. Head form 108 may include a convex arcuate surface. Also, the head form 108 can be fixed in size/shape, or alternatively adjusted in size/shape (e.g., expansion of underlying lattice structure, inflation, etc., depending on the materials of construction as described below). In various embodiments, head form 108 may have a hemispherical surface. In various embodiments, head form 108 may have a planar portion coupled to the rotating arm 104 with the convex arcuate surface disposed on the opposite side of head form 108. In various embodiments, head form 108 may include contours mirroring a human head, such as an anterior dome portion and lateral planar portions. Head form 108 may be formed from one or more plastics, such as high density polyethylene (HDPE).

In various embodiments, head form 108 may be formed from foam. In various embodiments, the head form 108 may include castable foam. In various embodiments, head form 108 may include foam that can be shaped via one or more additive or subtractive methods, such as carving, machining, sculpting, casting, 3D printing or any suitable manufacture. In various embodiments, the foam may be a rigid foam case in a mold formed from a 3D scan of a human head. Head form 108 may be cast in foam utilizing a two-piece mold, but it wouldn't release given the shape of the head and the rigidity of the foam. In various embodiments, head form 108 may be cast in a three-piece mold. In various embodiments, the head form 108 may include shape memory material configured to return to a desired shape after deformation or puncturing. In various embodiments, the head form 108 may be formed from foam that may be configured to expand inwardly to fill any gaps or holes formed therein, for example from a needle or puncturing device.

In various embodiments, head form 108 may be formed from silicone, such as a low durometer silicone (15A). Low durometer silicone may provide rigidity with some compression and flexibility to assist with hair holding. Silicone may be molded using a three piece mold. Head form 108 formed from silicon may be configured to secure hair and allow shuttle retraction after hair injection, as described herein below.

Figure 3A:
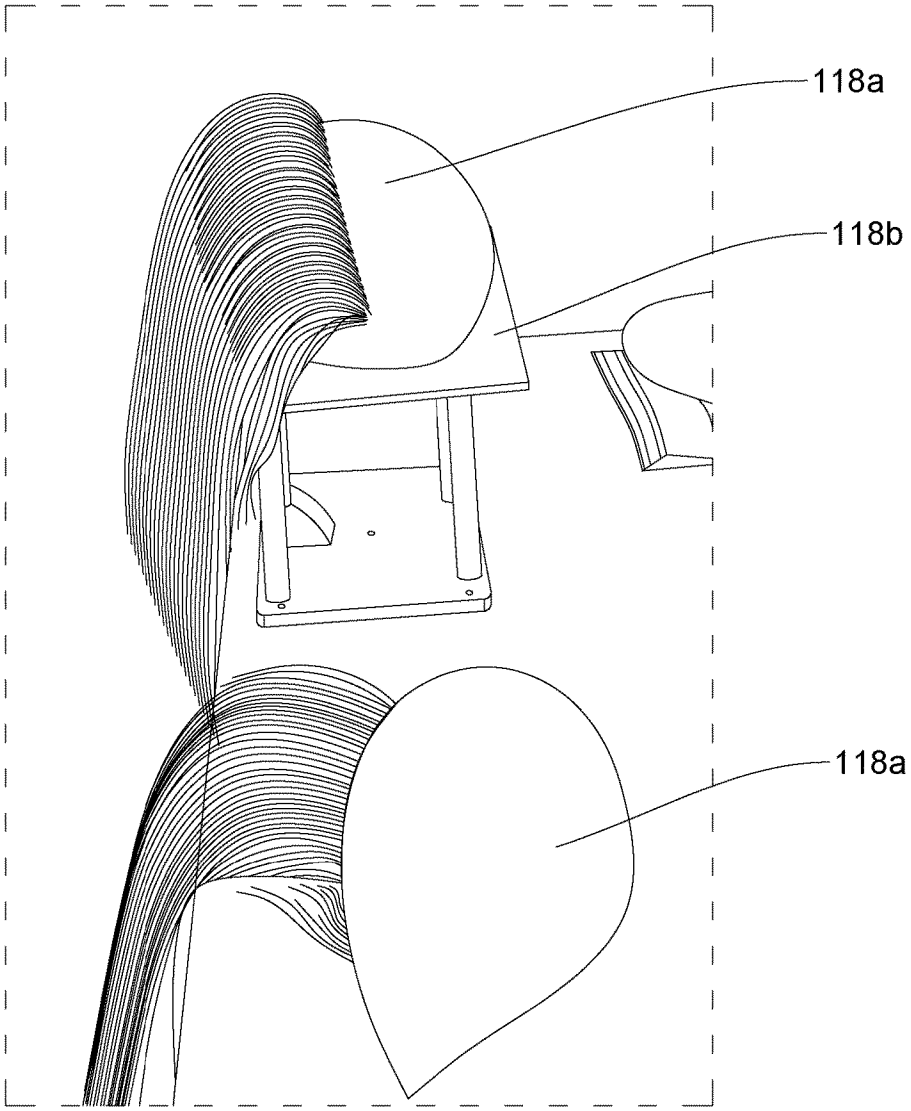
FIG. 3A is a representations of a cap and base layer with partially injected hair in accordance with the disclosed subject matter.
Figure 3B:
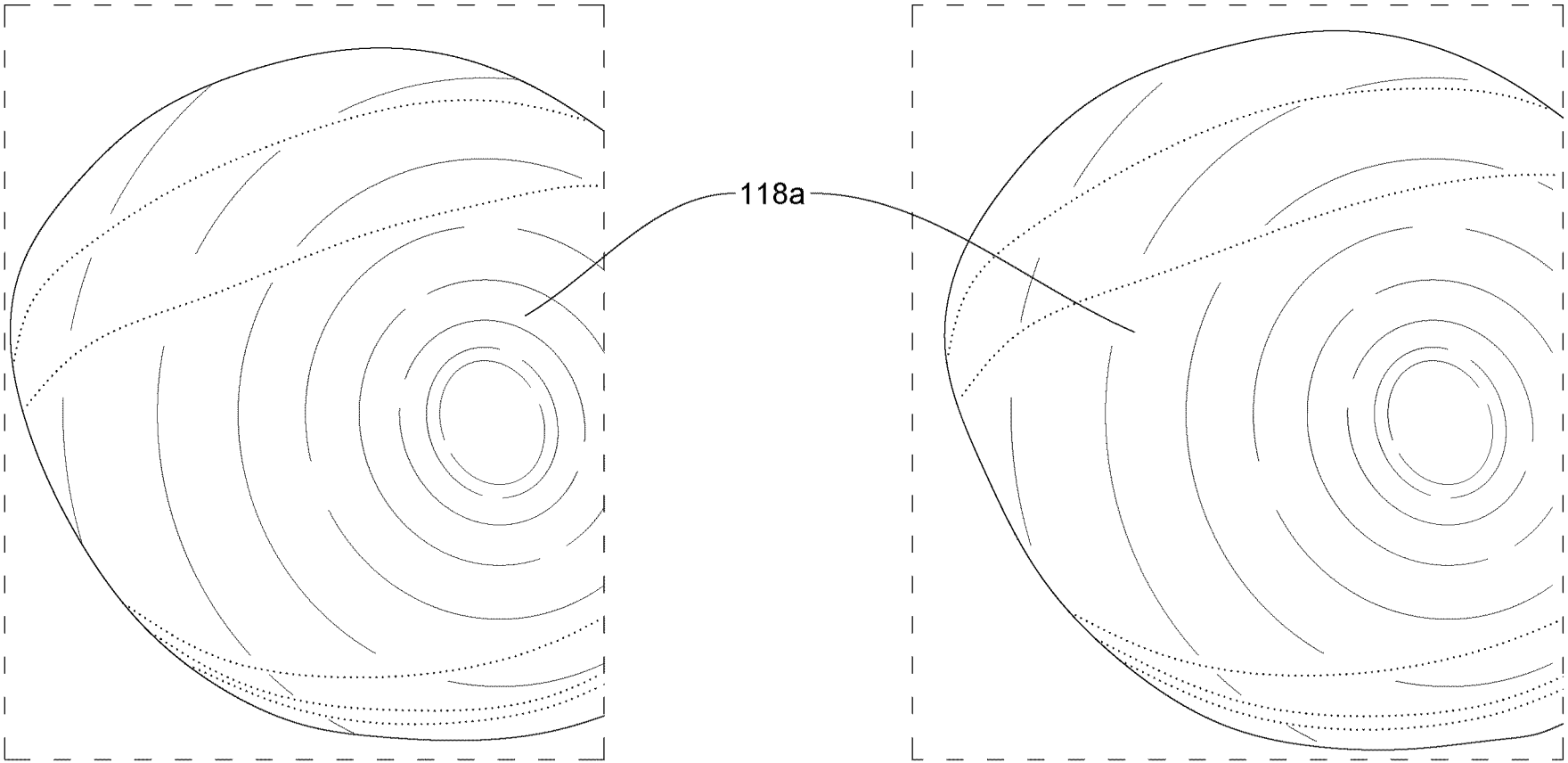
FIG. 3B is representation of a portion of a base layer in accordance with the disclosed subject matter

In various embodiments, head form 108 may include a base layer 108*a* disposed over the convex arcuate surface and a cap 108*b* disposed over the base layer 108*a*. In various embodiments, the base layer 108*a* may be formed from silicone, as shown in FIGS. 3A-B. The silicone base layer 108*a* may be configured to be an injection layer that is disposed over a more head form 108. The base layer 108*a* may include all of the contours of the underlying head form 108. Silicone base layer 108*a* may be configured to stretch over the head form 108, thereby adopting the underlying contours of the head form 108. In various embodiments, head form 108 may be made from plastic and provide structure for the silicone base layer 108*a* overlayed thereon. In various embodiments, head form 108 may be mechanically coupled to rotating arm 104 with silicone base layer 108*a* applied and removed each instance a wig is manufactured thereon, as will be described herein below.

In various embodiments, the silicone base layer 108*a* may be molded utilizing a two or three piece mold, including any other suitable mold. In various embodiments, the silicone base layer 108*a* may have a uniform thickness from approximately 1-10 mm. In various embodiments, the base layer 108*a* may have a uniform thickness from approximately 2-8 mm. In various embodiments, the base layer 108*a* may have a non-uniform thickness ranging from 1-10 mm dependent on location on head form 108. For example, and without limitation, the convex arcuate portion of the base layer 108*a* disposed over the crown of the head form 108 may be thicker than the extreme portions proximate the edges. Silicone base layer 108*a* may be configured to increase friction between the injected hair, securing the hair within the base layer 108*a*. Base layer 108*a* may be configured as a backing for cap 108*b*, such that the one or more needle injecting the hair through the cap 108*b*, may puncture 108*a* and not head form 108. Bas layer 108*a* may be configured to be integral to head form 108 or applied thereto prior to the injection procedure. In various embodiments, base layer 108*a* may be configured to be removed from the head form 108 with the cap 108*b* after injection. Base layer 108*a* may be removed from the cap 108*b* after injection and removal from head form 108. The base layer 108*a* may be reusable between discrete wig manufacturing procedures. For example, the base layer 108*a* may be treated between discrete wig manufacturing processes, such as the application of heat to resurface the base layer 108*a* for even injection.

In various embodiments, head form 108 may include a cap 108*b* disposed over the silicone base layer 108*a*, in various embodiments. The cap 108*b* may be formed from polyester. In various embodiments, the cap 108*b* may be formed of mesh fabric, for example by 5-45 dernier. In various embodiments, the cap 108*b* may be formed from lace. In various embodiments, the cap 108*b* may be formed from fabrican or another suitable sprayable fabric, in various embodiments, the cap 108*b* may be formed from gecko skin. In various embodiments, the cap 108*b* may be formed with openings therein to improve breathability. In various embodiments, the cap 108*b* may be configured to stretch over the silicone base layer 108*a*, head form 108 and ultimately, a head of a human. In various embodiments, the cap 108*b* may be formed from polyurethane (PU), such as a clear PU of various densities.

In various embodiments, the cap 108*b* include a circumference of approximately 20-25 inches, such as 23 inches. In various embodiments, the cap 108*b* may include a front to nape distance of 17 inch. In various embodiments, the cap 108*b* may include an ear to ear across forehead of 11.5 inches. In various embodiments, the cap 108*b* may include an ear to ear arcuate distance over the top of the cap 108*b* of 15 inches. In various embodiments, the cap 108*b* may include a temple to temple measurement of 16.5 inches. In various embodiments, the cap 108*b* may include a nape to neck measurement of 6 inches. In various embodiments, the cap 108*b* include a circumference of approximately 20-25 inches, such as 24 inches. In various embodiments, the cap 108*b* may include a front to nape distance of 14.5 inch. In various embodiments, the cap 108*b* may include an ear to ear across forehead of 12.75 inches. In various embodiments, the cap 108*b* may include an ear to ear arcuate distance over the top of the cap 108*b* of 14 inches. In various embodiments, the cap 108*b* may include a temple to temple measurement of 15 inches. In various embodiments, the cap 108*b* may include a nape to neck measurement of 5.5 inches.

Figure 3C:
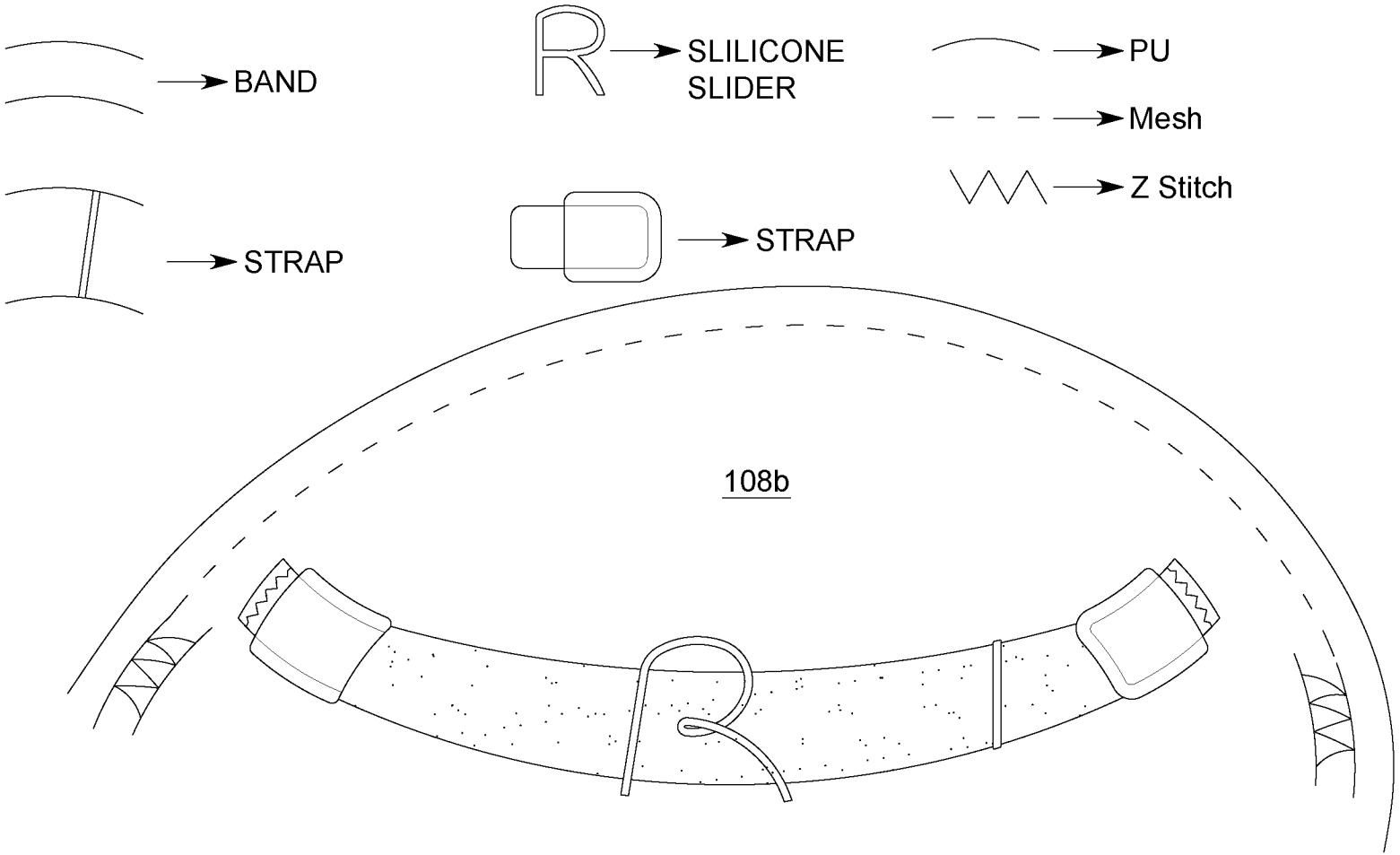
FIG. 3C is a schematic representation of a cap in accordance with the disclosed subject matter.

In various embodiments, the cap 108*b* may include an elasticated band around the circumference of the opening of the cap 108*b*. In various embodiments, the elasticated band may be nylon that is Z-stitched to the cap 108*b* with nylon thread such as shown in FIG. 3C. Further, cap 108*b* may include a strap extending across the interior of cap 108*b* and coupled at either end. Each end may be proximate the nylon band around the circumference of the cap opening. Said strap may include a nylon slider disposed thereon and configured to adjust the length, stiffness and/or slack of the strap. In various embodiments, cap 108*b* may be tightened on the head via this strap. The strap may be coupled to the interior of the cap through the mesh disposed within the interior of the cap 108*b*.

With continued reference to FIG. 1A-1E, system 100 includes a shuttle 116. Shuttle 116 may be slidingly coupled to the frame 102 for translational movement. Shuttle 116 may be configured to slide in a second direction, the second direction perpendicular to the first direction. In various embodiments, the second direction may be transverse to rotating arm 104. In various embodiments, the shuttle 116 may be slidingly coupled to at least one linear track 124 disposed parallel to each side rail within the interior space of frame 102. Shuttle 116 may have an arcuate edge that corresponds to a portion of the curvature of head form 108. The arcuate edge of the shuttle 116 corresponds to the curvature of head form 108 such that there are no gaps between the ends of the hair held by the ejector funnels of the shuttle 116 and the cap 108*b*. The shuttle 116 may also have an arcuate edge to grasp and locate the shuttle 116 relative to the head form 108 such that the hair is located symmetrically on the cap 108*b*. The arcuate edge of shuttle 116 may be malleable and be configured to form to the head form 108, thereby ensuring no gap is created between the shuttle 116 and head form 108.

Shuttle 116 may be configured to move between a proximal position 'B' and distal position 'C' within the system 100. Shuttle 116 may be reloaded at the proximal position. For example, shuttle 116 may be moved away from head form 108 for reloading. After reloading is complete, the shuttle 116 may then move to a distal position and in contact with the head form 108 (having base layer 108*a* and cap 108*b* placed thereon). The shuttle 116 may contact the head form 108 at the distal position, the contact point of the shuttle 116 and the head form 108 may be the target location such that the hair in the shuttle is brought into contact with the target location of the cap 108*b* and disposed underneath needle 112.

This disclosure does not seek to limit the movement shuttle 116 may employ to move from the proximal reloading position to the distal position. For example, and without limitation, shuttle 116 may be rotated out of contact with the head form 108 and brought to a reloading position away from said head form 108. Additionally, head form 108 may also rotate out of contact with the shuttle 116, thereby providing access to the cartridges 120 on the shuttle 116 for reloading. Shuttle 116 may travel any path between a reloading position and injection position. In various embodiments, shuttle 116 may be positioned proximate the head form 108 and in contact with head form 108. A user may then remove the shuttle 116 for reloading and recouple the shuttle 116 once completed. In various embodiments, the head form 108 may rotate while in contact with the shuttle 116 between injection procedures. For example, and without limitation, the shuttle 116 may locate the hair on the cap 108*b*, its injected, the head form 108 rotates and the process is repeated.

In various embodiments, shuttle 116 may be configured to slide along the at least one track 124 from a proximal end to a distal end, wherein the proximal end is proximate the edge of frame 102 and the distal end is proximate the head form 108 and rotating arm 104. In various embodiments, the shuttle 116 may translate along the at least one track 124 via a worm screw disposed thereunder. In various embodiments, shuttle 116 may be propelled along the at least one track 124 via pneumatic or hydraulic cylinders. In various embodiments, shuttle 116 may be propelled along the at least one track 124 via one or more electric motors, stepper motors, servomotors, or the like. In various embodiments, the shuttle 116 may be computer controlled and may be configured to stop along any point along the at least one track 124 between the proximal end and the distal end. In various embodiments, shuttle 116 may be releasably coupled to the at least one track 124, the shuttle shown in FIG. 2B.

With continued reference to FIG. 1A-1E, system 100 includes an injector needle 112. Injector needle 112 may be oriented vertically and coupled to an injector arm. The injector arm may be configured to translate along the first direction from the first side to the second side of the frame. Additionally, the injector arm may be configured to translate inward and outward of the interior space of frame 102. In various embodiments, injector arm may be configured to rotate or translate along any axis. In various embodiments, injector arm may be configured to rotate and translate along any of the three dimensions axes. In various embodiments, injector arm may be formed as a robotic arm such as a 6-axis robotic arm. In various embodiments, the injector arm and injector needle 112 may be configured to rotate in an arcuate path relative to the frame and corresponding to the convex arcuate portion of the head form 108. For example, injector needle 112 may be configured to follow an arcuate path over the head form 108 with the needle proximate the head form and disposed normal to the convex arcuate surface.

Injector needle 112 may be configured to rapidly puncture cap 108*b* and base layer 108*a* in arcuate paths. the hair may be loaded into the plurality of cartridges 120 with the ends exposed through the funnels 118 onto the target location of cap 108*b*. The injector needle 112 may be configured to force the hairs through the cap 108*b* and into base layer 108*a*, thereby securing the hair into the cap 108*b*. In various embodiments, hair is secured in the cap 108*a* via friction. The cap 108*b* may expand to constrict the holes in which the hair is injected to hold the hair in the cap 108*b*. In various embodiments, the hair may be secured in the cap 108*b* via sutures or thread such that the hair is sewn to the cap 108*b* and the mesh thereunder, in embodiments. In various embodiments, the injector needle 112 may be configured to sew the hair into the cap 108*b* via a single or double thread, where the thread is woven between the hair and the cap 108*b* and securing the hair into said cap. The injector needle 112 may sew the hair into the cap 108*b* in arcs that correspond to the arcuate path of the injector arm over the head form 108. Hair may be injected into cap 108*b* or sewn into cap 108*b* in parallel arcs parallel to one another over the surface of the cap 108*b*. In various embodiments, the thread may be nylon thread.

Additionally, or alternatively, cap 108*b* may have a layer of mesh disposed thereunder, the hair forced into contact with the mesh and secured in the cap 108*b*. In various embodiments, cap 108*b* may have glue applied to the interior portion where the ends of the hairs have been injected in order to hold the hair into the cap 108*b*. In various embodiments, the glue may be rice glue or any other suitable adhesive.

After the hair is injected into the cap 108*b* and base layer 108*a*, the shuttle 116 may retreat away from head form 108, the remainder of the hair thereby being pulled out of the cartridges through the funnels 118. The frame 102 may further include a nozzle 128 directed toward the target location of the head form where the hair is injected and blows a gas, such as compressed air towards the hair and blow said hair in a direction opposite the shuttle 116, thereby displacing/removing the hair from the path of the shuttle 116 as it readvances toward head form 108 for the next row of hair injection. In various embodiments, the nozzle 128 is disposed on the shuttle 116. In various embodiments, the nozzle 128 is disposed on the frame 102. In various embodiments, the nozzle 116 is disposed on the head form 108 or rotating arm 104. The injector needle 112 may be seen angled with the needle toward head form in a point along its arcuate path in FIG. 6A.

Figure 2A:
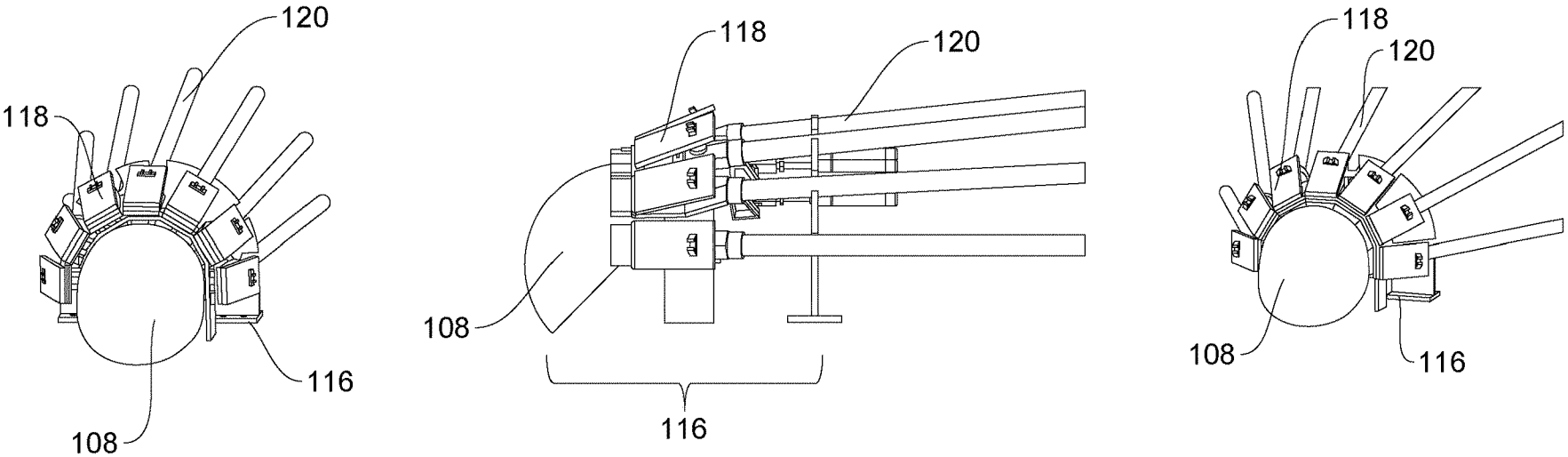
FIGS. 2A-2F are schematic representations of a shuttle and components thereof in accordance with the disclosed subject matter.
Figure 2C:
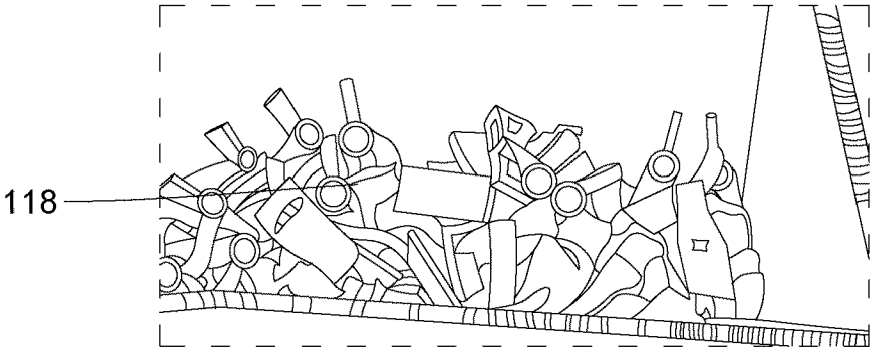
Figure 2B:
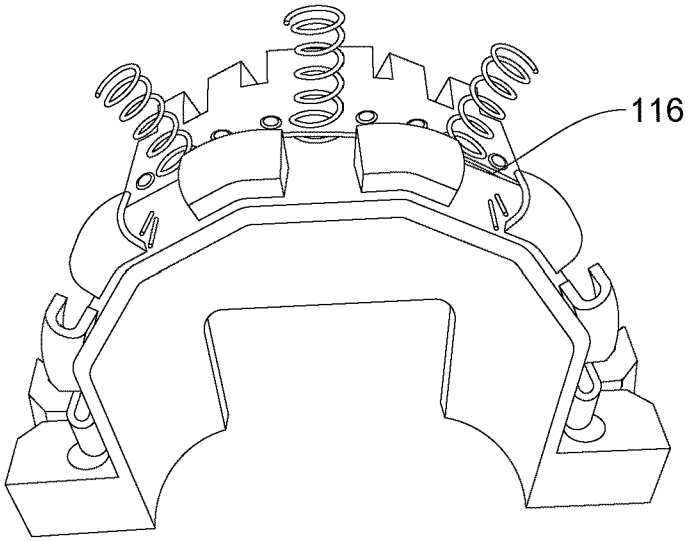
Figure 2D:
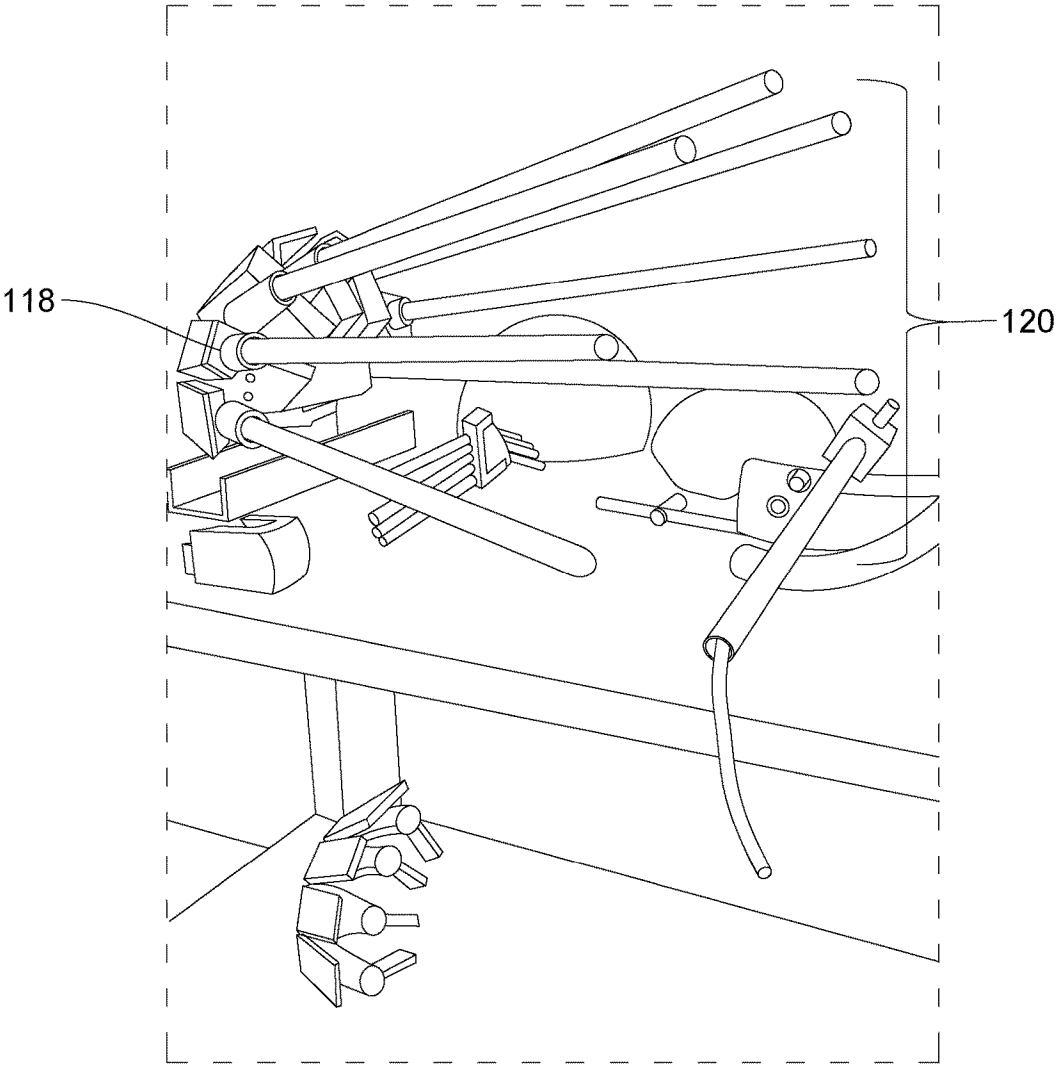

Referring now to FIG. 2A-2C, shuttle 116 is shown in a plurality of perspective, orthogonal, and component detail views. FIG. 2A depicts shuttle 116 as it engages the curvature of head form 108, but this is for illustration purposes only and does not seek to limit the disclosure. Shuttle 116 may include a plurality of a plurality of funnels 118 disposed about the arcuate edge of shuttle 116. The plurality of funnels 118 may be disposed on the shuttle 116 proximate the head form 108 within frame 102. Each funnel 118 can move independently with respect to each other, and slide along the sloped face of the shuttle 116 so that each funnel can adjust position to ensure flush engagement with its leading edge with the abutting head form 108. In various embodiments, funnels 118 may have a first end and a second end, the first end coupled to the shuttle 116 and the second end disposed forward of the arcuate edge of shuttle 116 overhanging and angled inward towards the center of the arcuate edge. In various embodiments, the plurality of funnels 118 may include seven discrete funnels disposed about the arcuate edge. In various embodiments, there may be any number of funnels 118, for example, 5, 6, 8, 9, 10, 20, 30 or 40 funnels. In various embodiments, funnels 118 may be configured to be biased inwardly in order to grip the head form 108 when the shuttle 116 is at the distal position along the track 124. In various embodiments, the plurality of funnels 118 may be configured with an opening therethrough. The opening may extend from the first end of the funnel to the second end of the funnel. The cartridge 120 with funnel 118 loaded with a bundle 204 of hair can be seen in the topmost portion of FIG. 2F. A shuttle 116 loaded with hair-laden cartridges 120 can be seen in the lowermost portion of FIG. 2F.

Figure 2E:
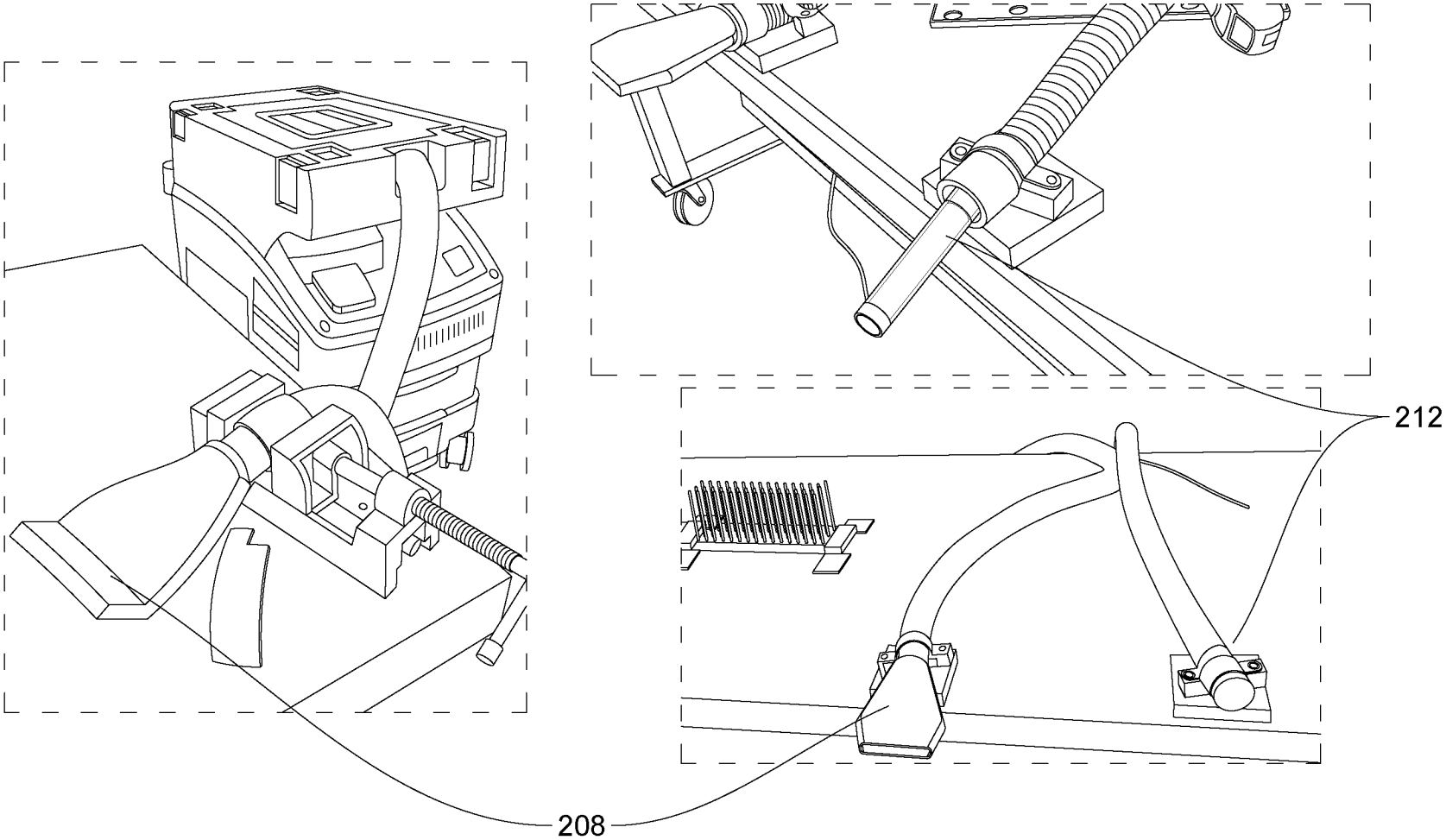
Figure 2F:
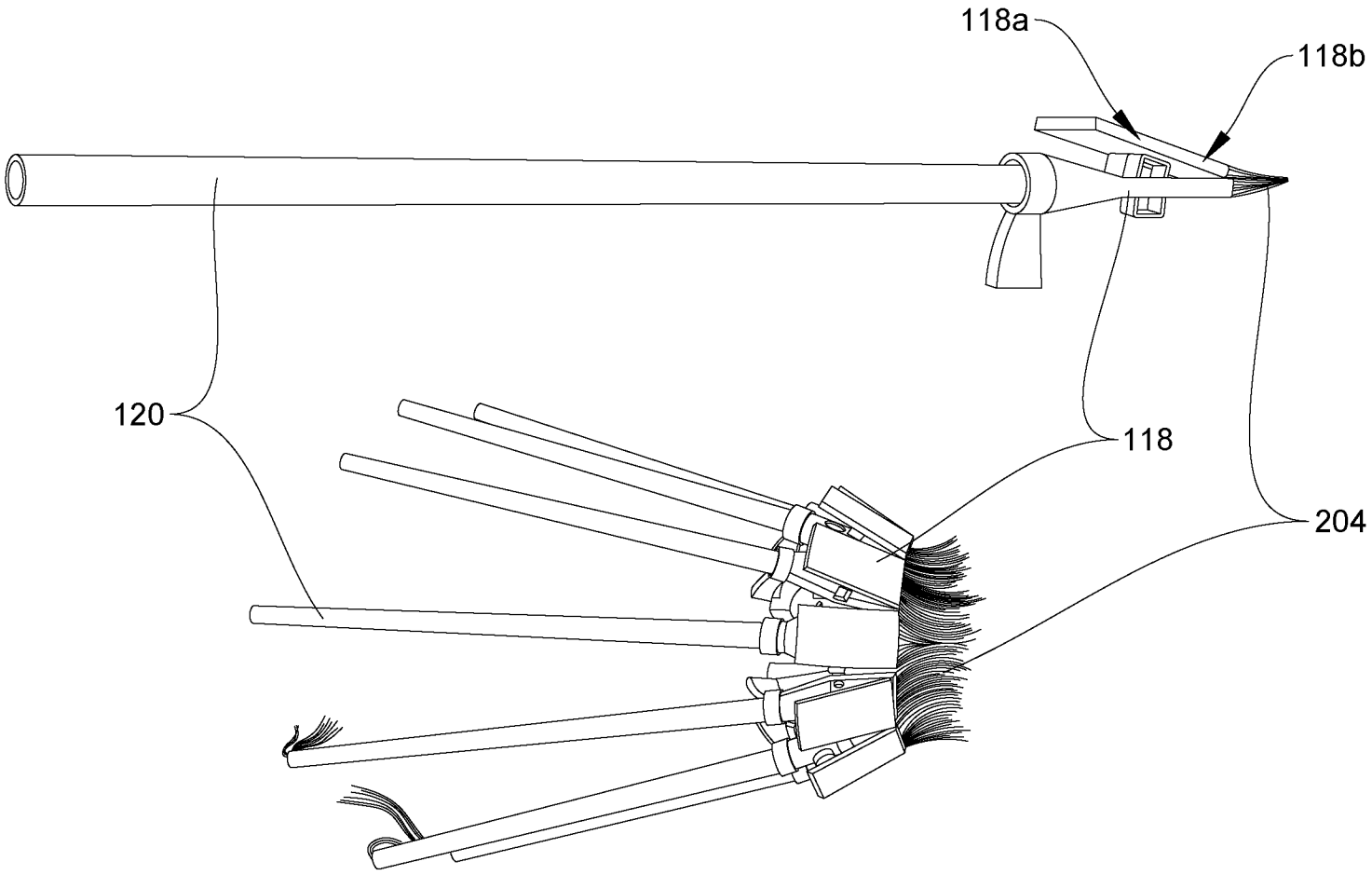

As shown in FIG. 2F, the funnels 118 can have a channel or aperture on the distal end for receiving cartridge 120, and a clamp 118*a* (e.g. spring force) which biases the top panel 118*b* of the funnel to pinch the hair along the proximal edge of the top panel 118*b*.

With continued reference to FIG. 2A-2C, system 100, and specifically shuttle 116 includes a plurality of cartridges 120 coupled to the plurality of funnels 118. In various embodiments, each cartridge 120 of the plurality of cartridges may have a first end and a second end with a tubular sidewall extending therebetween. In various embodiments, the cartridges 120 may have any cross section shape, such as a rectangle, triangle, or polygon, thereby forming a prismatic shape. Cartridges 120 may have an opening in one or both ends of the cartridges. In various embodiments, the opening(s) may be selectively closable. In various embodiments, the plurality of cartridges may be loaded into the funnels 118. In various embodiments, the plurality of cartridges 120 may be loaded (preloaded, automatically or manually) with a bundle 204 of hair extending along the interior of the cartridge as shown in FIGS. 2D and 4A-4C. In various embodiments, the plurality of cartridges 120 may be configured to be automatedly reloaded into the funnels 118. The plurality of cartridges may be disposed about the arcuate edge of shuttle 116 in a single row. In various embodiments, the plurality of cartridges 120 may be disposed along the arcuate edge of shuttle 116 may be disposed in a plurality of rows, such as two rows.

Figure 4B:
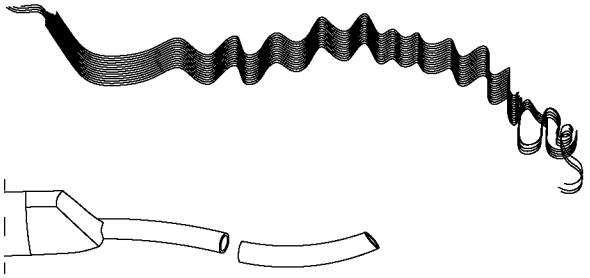
FIGS. 4A-4D are representations of hair bundles loaded into cartridges and a funnel in accordance with the disclosed subject matter.
Figure 4A:
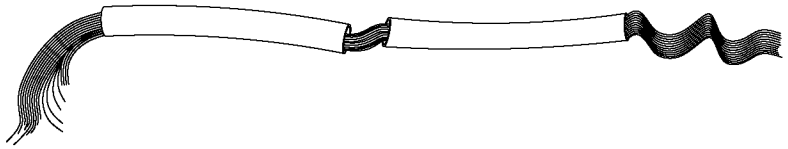
Figure 4C:
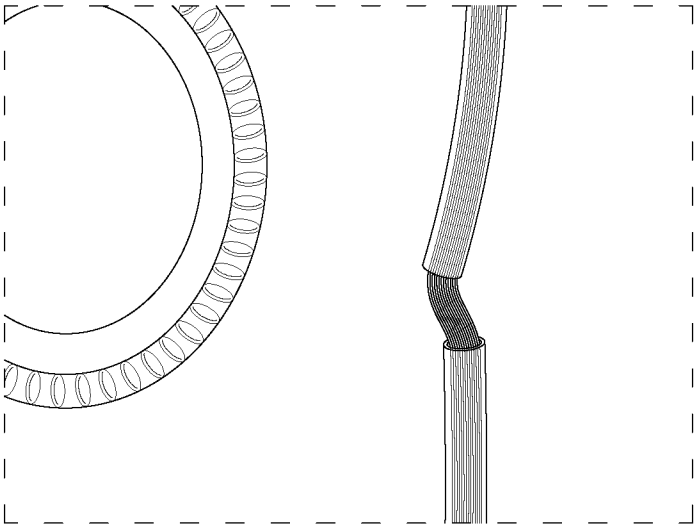
Figure 4D:
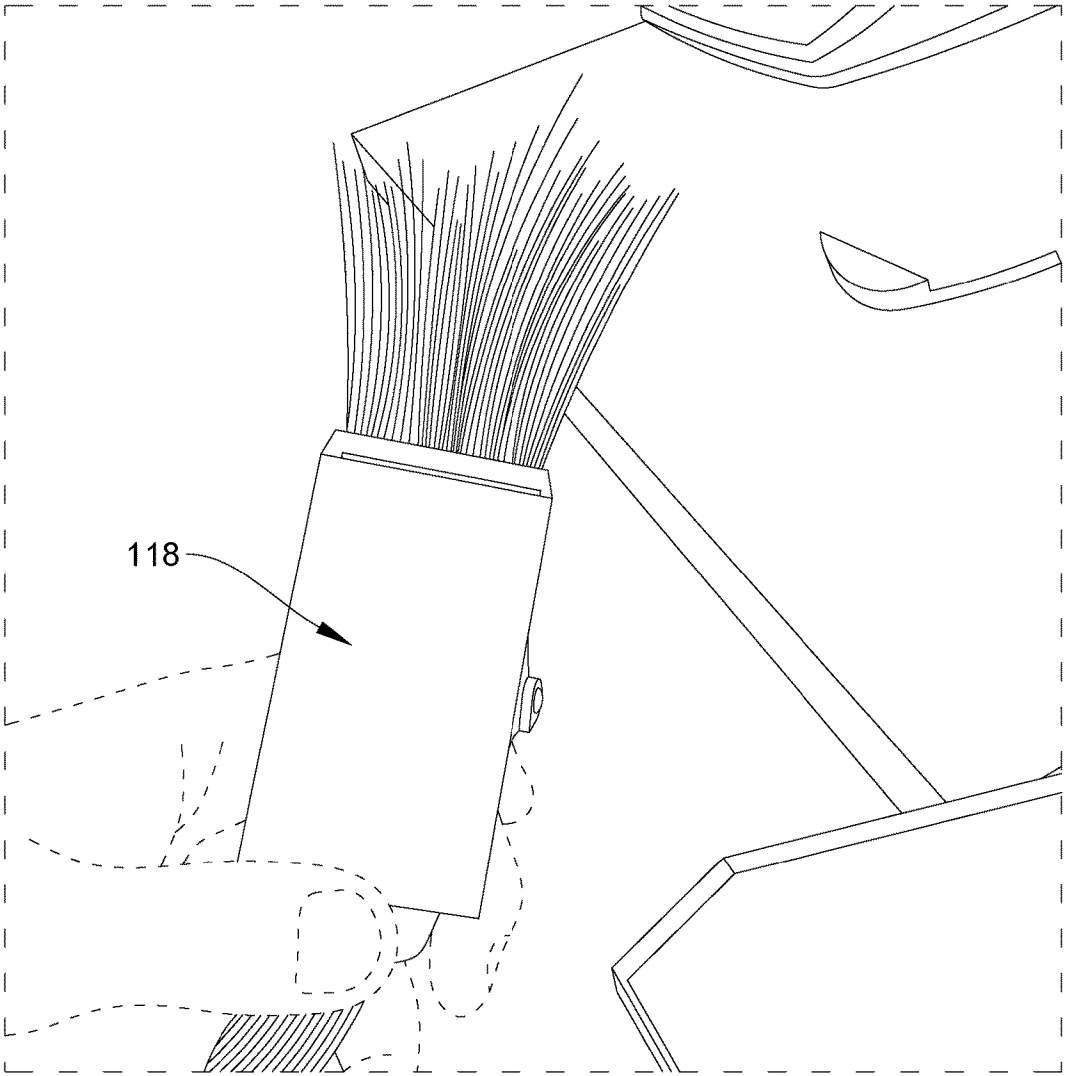

In various embodiments, hair may be loaded into the plurality of cartridges under the pressure of vacuum components 208, 212 as shown in FIG. 2E. The vacuum components may be configured to maneuver the bundle 204 of hair into the plurality of cartridges 120. In various embodiments, loading hair into the cartridges 120 may include hackling the hair and trimming the bundle 204 of hair ends to achieve a uniform edge. In various embodiments, loading the hair into the cartridges 120 may include prying/holding cartridge funnel 118 open with a loading tool and inserting the hair bundle therein. The user may then utilize a first vacuum 208, loading hair into the funnel. The funnel 118 may be held flat to feed all hair into the funnel 118 and then slowly tilted up so the hair fans out. A flat layer of fanned out hair is the end state, in various embodiments, as depicted in FIG. 4D. After loading into the cartridges, the ends of the hair may be hackled. In various embodiments, a second vacuum 212 may be utilized to hold a cartridge 120 and subject the cavity to a vacuum, the hair that is now inserted into the funnel may then be fed into the cartridge and pulled through by the second vacuum 212.

Figure 5:
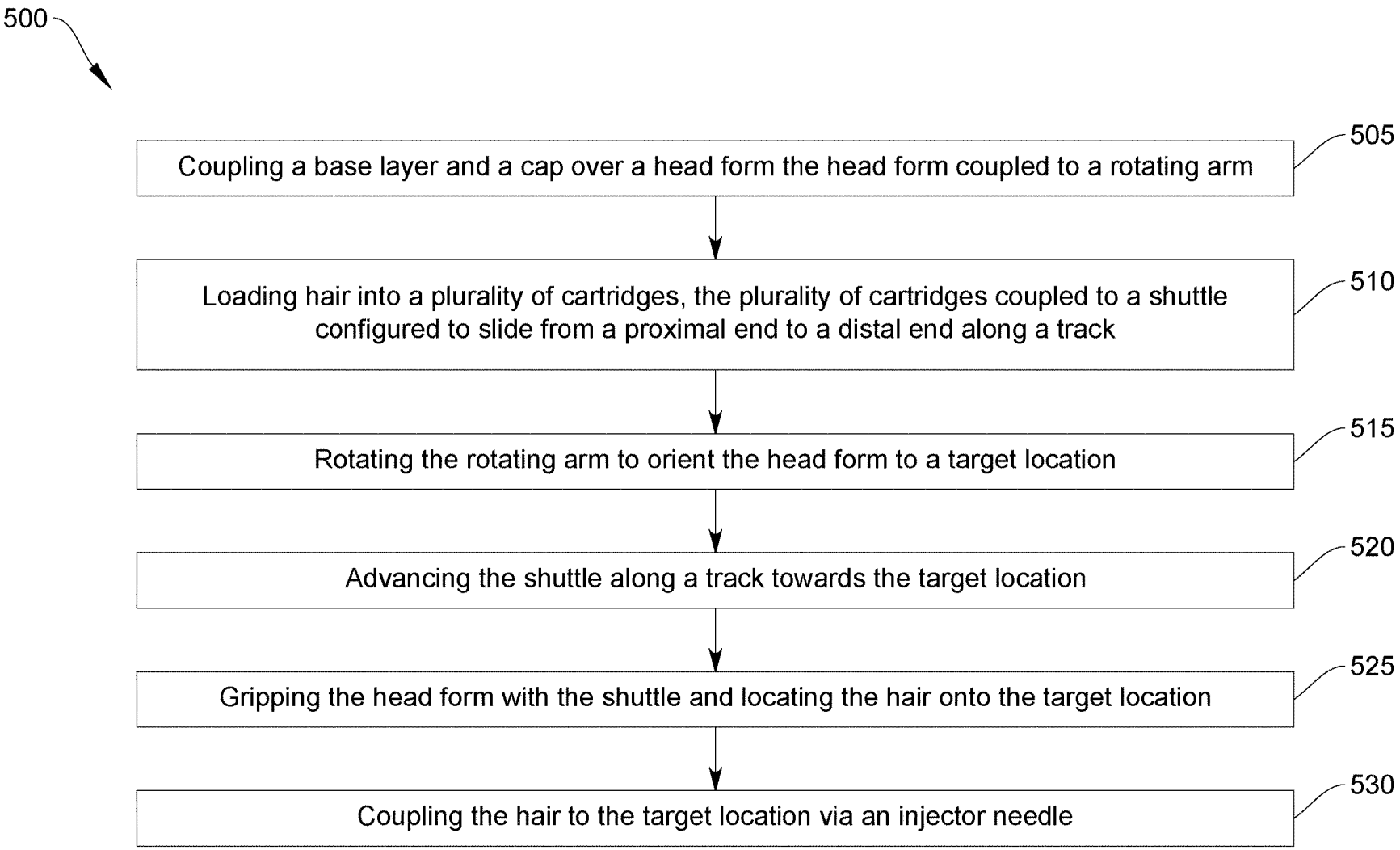
FIG. 5 is a flow chart depicted a method for wig manufacture in accordance with the disclosed subject matter.
Figure 6A:
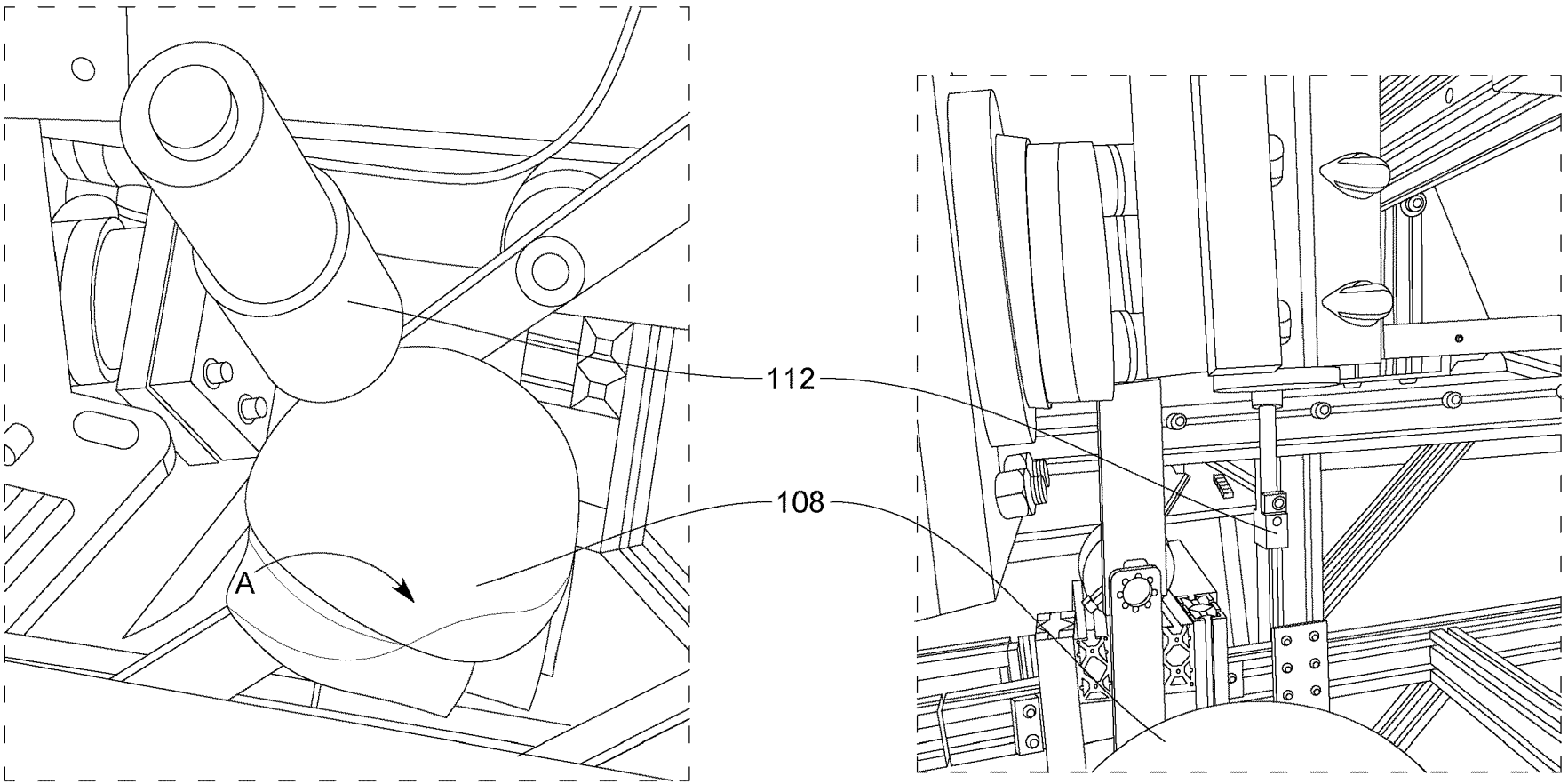
FIGS. 6A-6F are representations of the system for wig manufacture at various points in the manufacture process in accordance with the disclosed subject matter.
Figure 6B:
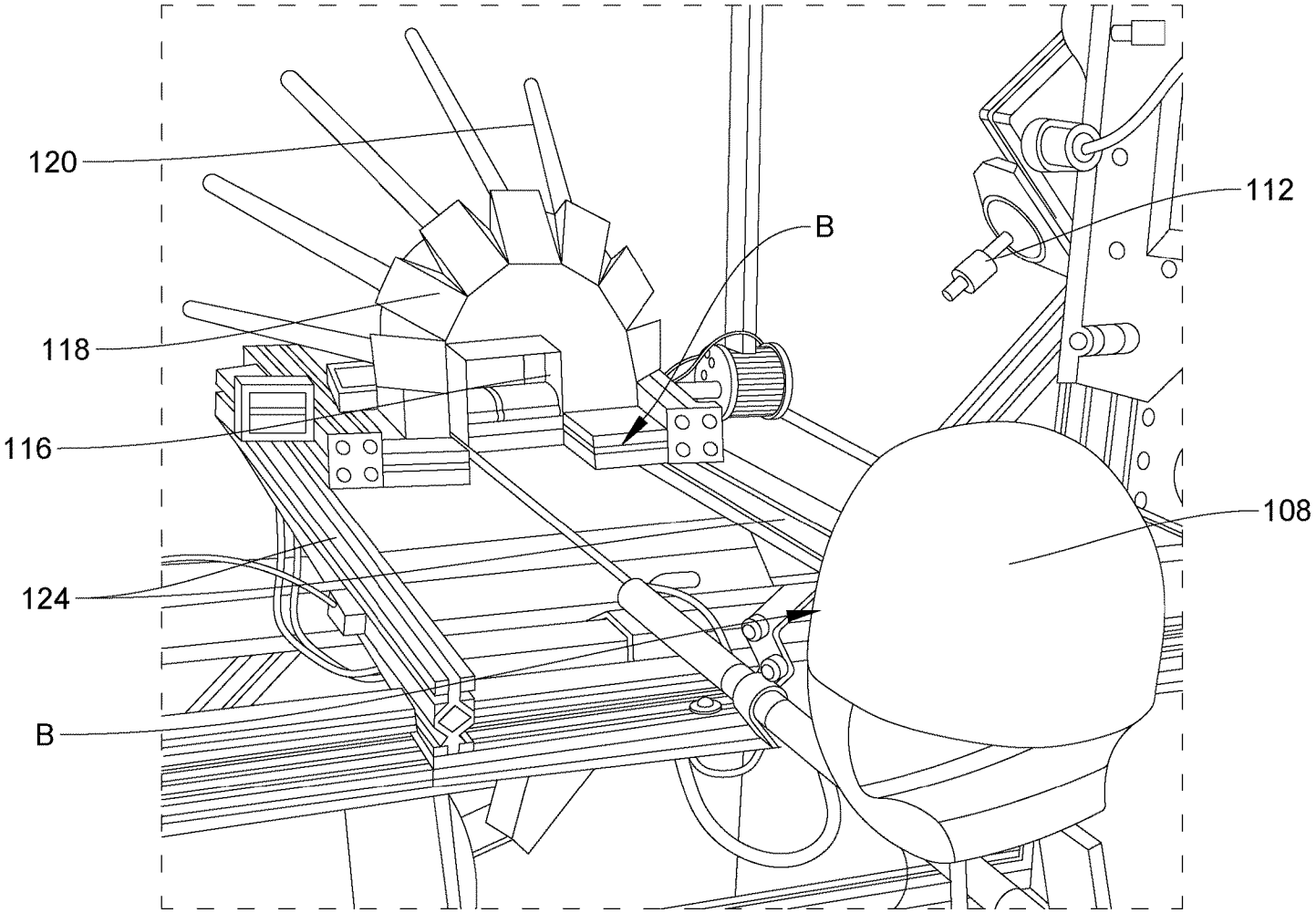

Referring now to FIG. 5, a method 500 for wig manufacture is shown in flow chart form. Method 500, at step 505, includes coupling a base layer 108*a* and a cap 108*b* over a head form. The head form may be the same or similar to head form 108 as shown in FIGS. 6A and 6B and described herein. Head form 108 may be rotatably coupled to rotating arm 104, as described herein. Head form 108 may be rigidly coupled to rotating arm 104 and configured to rotate relative to the shuttle 116 when the rotating arm 104 rotates about its axis. Head form 108 rotates in order to orient the cap 108*b* relative to the shuttle 116 and therefore locates the hair for injection into cap 108*b*. Head form 108 rotates a certain amount every hair injection procedure, such as to locate successive rows of hair on the cap 108*b* to eventually form a full wig. For example, the hair may be injected on a first part of the cap 108*b* corresponding to the hairline of the forehead, the head may then rotate further so hair may be injected in a parallel row corresponding to the hair immediately behind the forehead hairline on the head. Head form 108 may rotate 180 degrees or more in order to inject hair over the entirety of the desired location on cap 108*b*. Head form 108 may be rigid and formed from a foam or plastic. Base layer 108*a* may be formed from silicone and cap 108*be* may be formed from polyurethane disposed thereover. Coupling the base layer 108*a* over the head form may include stretching the silicone over the head form and fastening with one or more mechanical fasteners, such as pins, nails, clips, or the like. The cap 108*b* may be disposed over the base layer 108*a* by stretching an opening of the cap 108*b* over the domed base layer 108*a* (over head form 108). The cap 108*b* may be stretched to fit the contours of the base layer 108*a* and secured with a nylon strap or fastener, much in the same way as base layer 108*a* to head form 108. As shown in FIG. 6A, the head form 108 may be disposed proximate and under the injector needle 112, the injector needle may have a starting position retracted above the head form 108. Injector needle 112 may have a stowed position to remove itself from the operating area and/or cover the needle for operator safety.

With continued reference to FIG. 5, method 500 includes, at step 510, loading hair into a plurality of cartridges. The plurality of cartridges may be the same or similar to cartridges 120. In various embodiments, the cartridges may be generally long prismatic shapes with hollow cavities extending longitudinally therethrough. The cartridges 120 may be configured to be loaded with hair, wherein the hair extends through the longitudinal cavity of the cartridges, the hair configured to extend through at least one end of the cartridge. In various embodiments, the plurality of cartridges are loaded into a shuttle 116, the shuttle 116 having funnels 118 configured to receive the cartridges. The hair may be loaded into the plurality of cartridges in bundle 204*s* of a predetermined weight or mass, for example and without limitation, 11 grams.

Figure 6C:
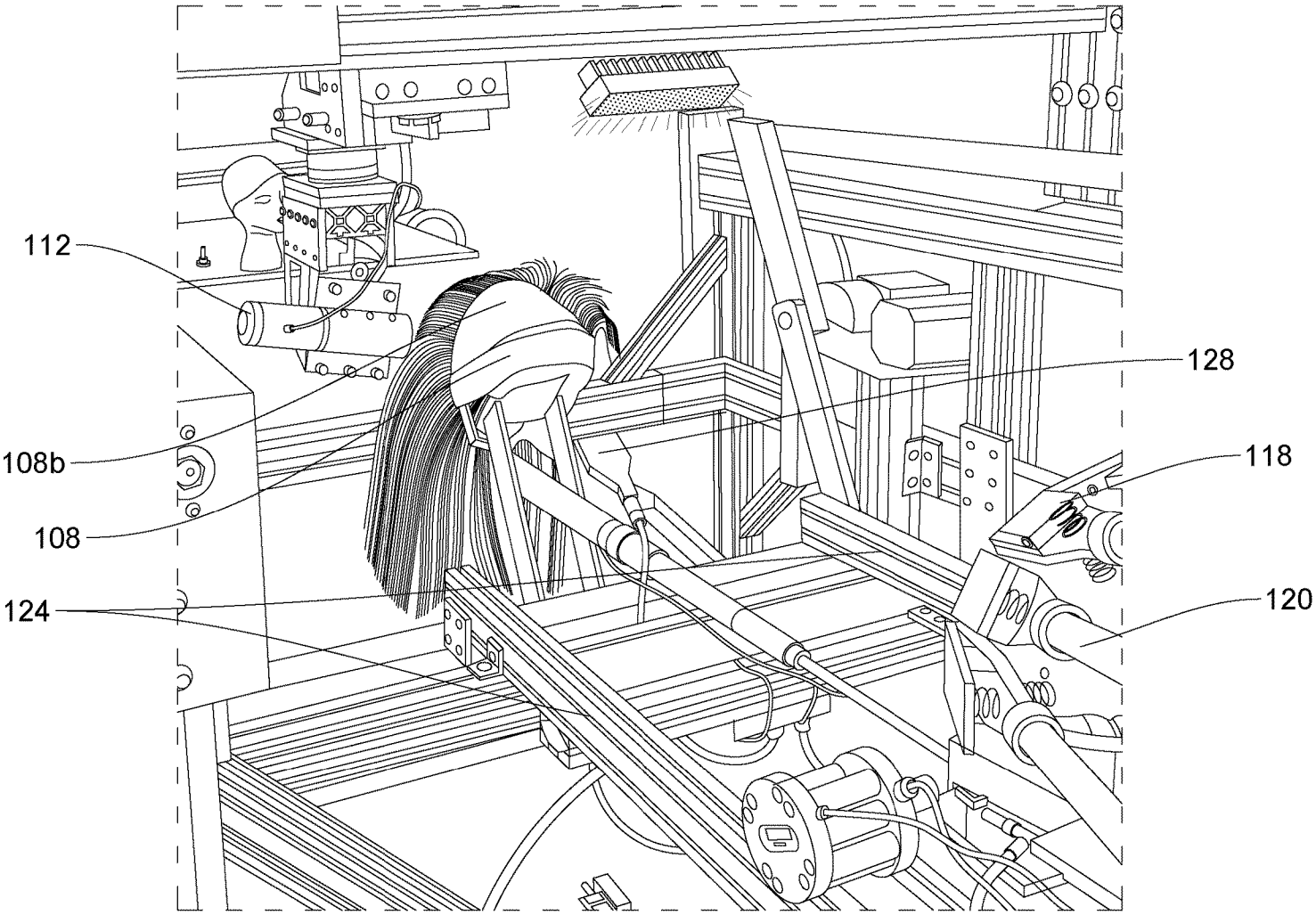
Figure 6D:
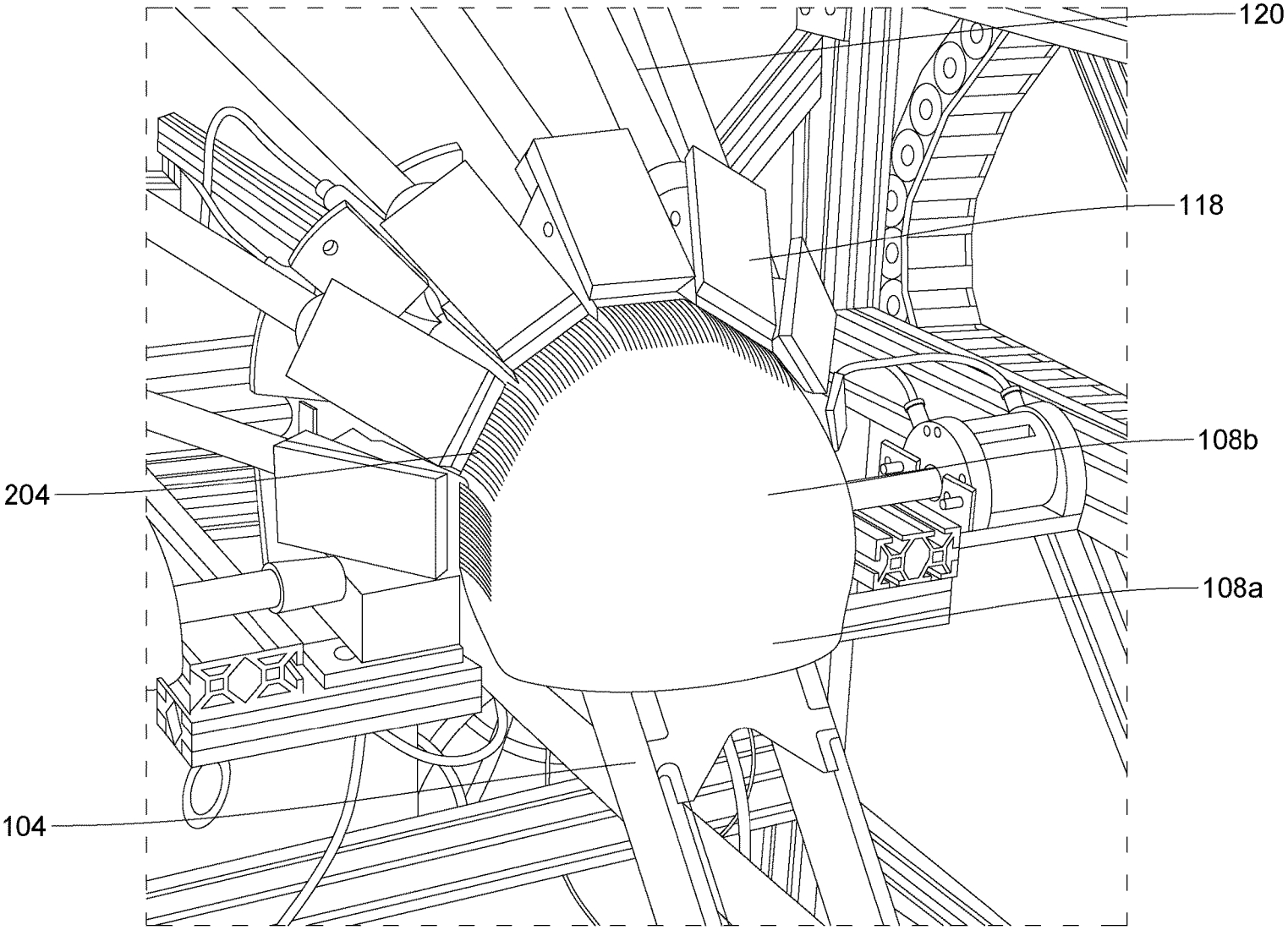

The funnels 118 may be spring loaded or actuated and configured to rotate inward towards a center of an arcuate edge of the shuttle 116 it is disposed. In various embodiments, the plurality of cartridges 120 are configured to be loaded with a predetermined amount of hair in each, as shown in FIGS. 2F and 4A-4C. In various embodiments, the plurality of cartridges 120 may be configured to be loaded under a pressure differential provided by a vacuum component coupled thereto, thereby pulling hair through the longitudinal cavity of the plurality of cartridges 120. The plurality of cartridges 120 may be configured to releasably couple to the funnels 118 and extend in a direction disposed opposite the track and head form 108, thereby providing clearance for the extended cartridges 120 from the path of the shuttle 116. In various embodiments, the hair inside the plurality of cartridges is pulled through the front of the funnels 118 after coupling the cartridges 120 to the shuttle 116, thereby exposing the ends of the hair 204 for contact with the cap 108*b* as shown in FIG. 6D. The shuttle 116 may be disposed at a proximal end of a track for the loading of cartridges 120 into the shuttle 116. The proximal end of the track may be an opposite end of track 124 from head form 108, identified by location B in FIG. 1D. In various embodiments, the shuttle 116 may be removed from the track 124 for loading procedures, and recoupled thereto after the plurality of cartridges are inserted into the funnels 118. FIG. 6B depicts shuttle 116 loaded with the plurality of cartridges 120 at a proximal end of the track 124 with an arcuate edge of the shuttle oriented towards the head form 108.

With continued reference to FIG. 5, method 500 includes, at step 515, rotating the rotating arm with the head form 108 coupled thereto to a target location. Rotating the rotating arm 104 may include actuating the rotating arm 104 along an axis spanning in a first direction transverse to the shuttle 116's track 124. Rotating the rotating arm 104 may include actuating the rotation via one or more actuators as described herein. The head form 108 may be rotated along an arcuate path circumscribing the rotating arm 104. The head form 108 may be tilted relative to the frame 102 to orient a target location on the head form 108 in the path of the shuttle 116. The target location may be an arcuate zone on the head form 108 corresponding to the funnels 118. The head form 108 may be rotated such that an edge portion of the head form 108 is oriented in the path of the shuttle 116, thereby defining the edge of the hair to be injected into the head form 108. The head form 108 may be rotated a certain number of degrees (e.g., indexed) each time the shuttle advances in order to inject hair in parallel rows over the entire target location of the head form 108, eventually forming a full wig.

The head form 108 may be rotated a predetermined angle each successive shuttle advancement so hair is injected into the head form 108 in adjacent rows (with each row spanning from "ear to ear" or laterally across the head form 108; additionally, or alternatively each row can span from "forehead to back" or longitudinally along the head form 108). In various embodiments, head form 108 may be rotated such that a predetermined pattern of hair is injected (via the needle operation described above) into head form 108, such as injecting the hair line and nape first, then filling in the remainder of the heads hair therebetween. FIGS. 6A-6C depict the head form 108 in a plurality of angles relative to the track 124, thereby providing a different target location in each representation. The head form 108 may be angled such that any portion of head form 108 is oriented in the path of the shuttle 116 and thus can be injected with hair.

With continued reference to FIG. 5, method 500 includes, at step 520, advancing the shuttle 116 along the track 124 from the proximal end to the distal end. Advancing the shuttle 116 may include advancing the shuttle 116 manually. In various embodiments, advancing the shuttle 116 along the track towards the head form 108 may include actuating the shuttle along the track via any actuator described herein or suitable for said advancement. In various embodiments, shuttle 116 may be advanced along the track 124 via one or more worm screws, electric motors, or the like. In various embodiments, advancing the shuttle 116 from a proximal end of the track 124 to the distal end of the track 124 includes contacting the shuttle 116 with the head form 108 at the target location. The shuttle 116 may be advanced any distance to and from head form 108. Shuttle 116 may be advanced toward head form 108 after the head form 108 rotates to the desired target location. Shuttle 116 may move any distance back and forth along track 124 from head form 108. Advancing shuttle 116 may take place after shuttle 116 is loaded with cartridges 120 having bundles of hair 204 loaded therein.

Figure 6E:
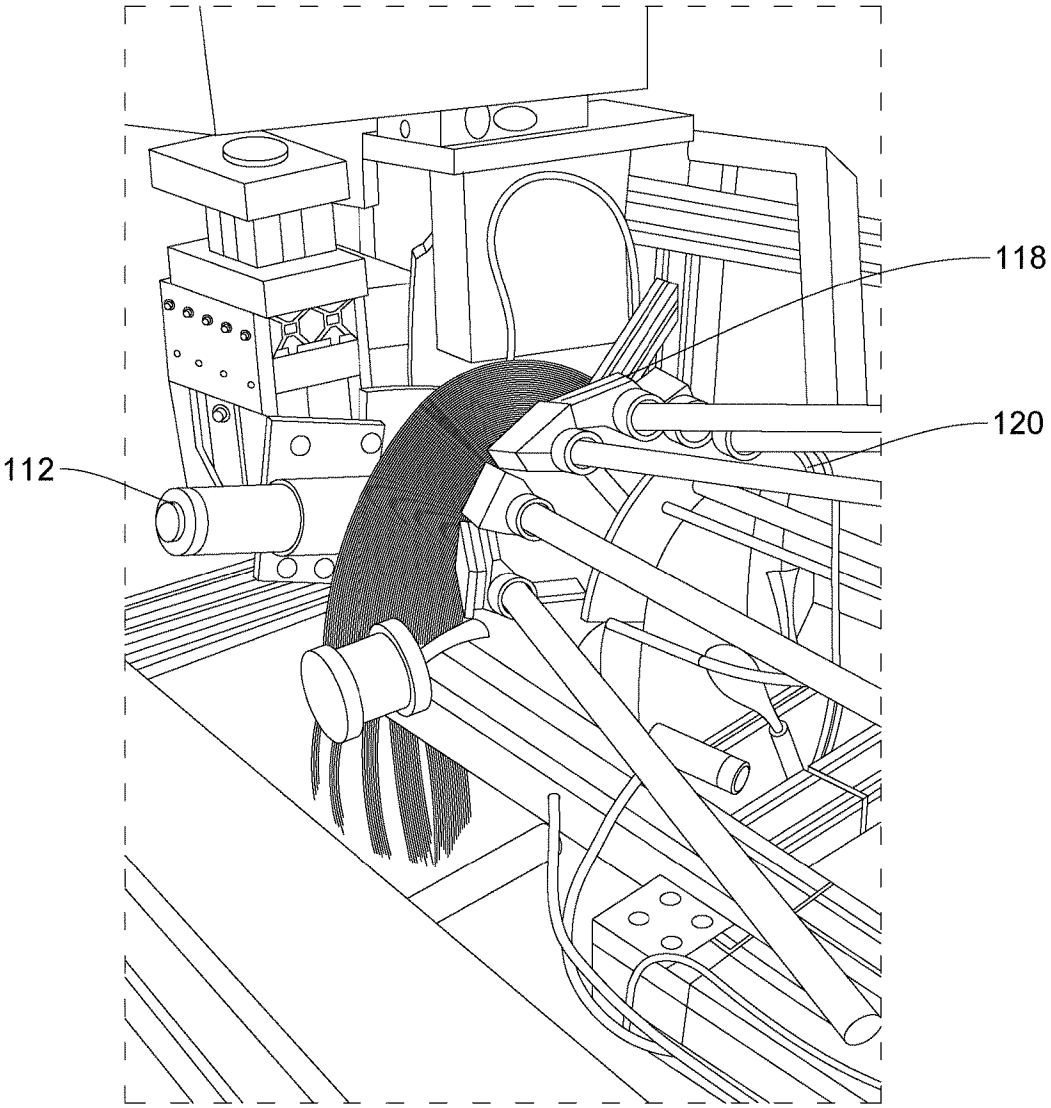
Figure 6F:
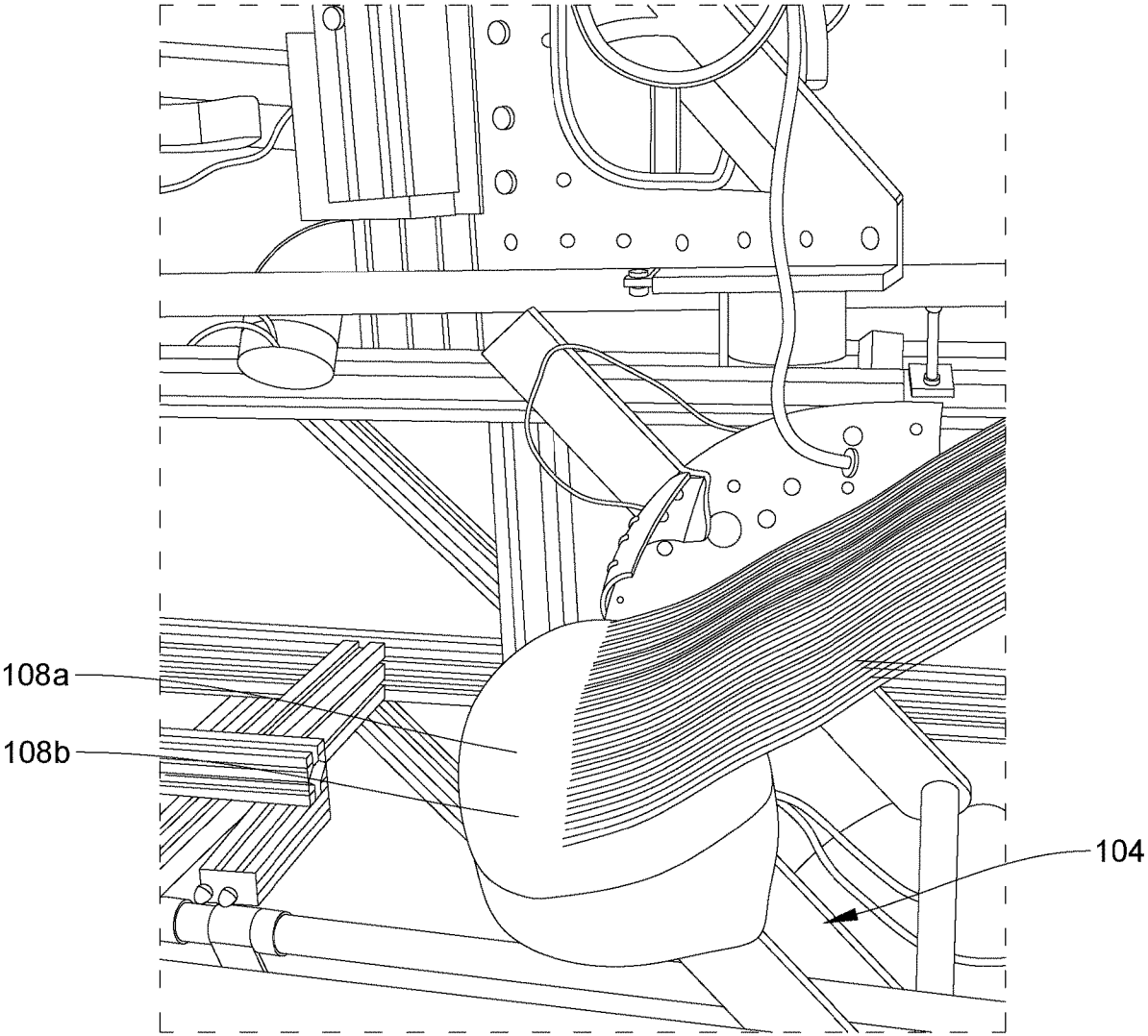

With continued reference to FIG. 5, method 500 includes, at step 525, gripping the head form 108 with the shuttle 116, the shuttle 116 configured to: i) position each funnel 118 so as to adapt the shape of the leading edge contour to correspond to the exterior surface of the head form 108; and ii) locate the hair onto the target location of the head form for injection. In various embodiments, as shown in FIGS. 6D and 6E, the arcuate edge of shuttle 116 with the plurality of funnels 118 may engage the head form 108, as will be described hereinbelow. Funnels 118 may engage the head form 108 under the tension of a spring disposed between the funnel 118 and shuttle 116, wherein the spring biases a first end of the funnel upward and a second end of the funnel 118 is cantilevered downward and forced into contact with the surface of head form 108.

Figure 7:
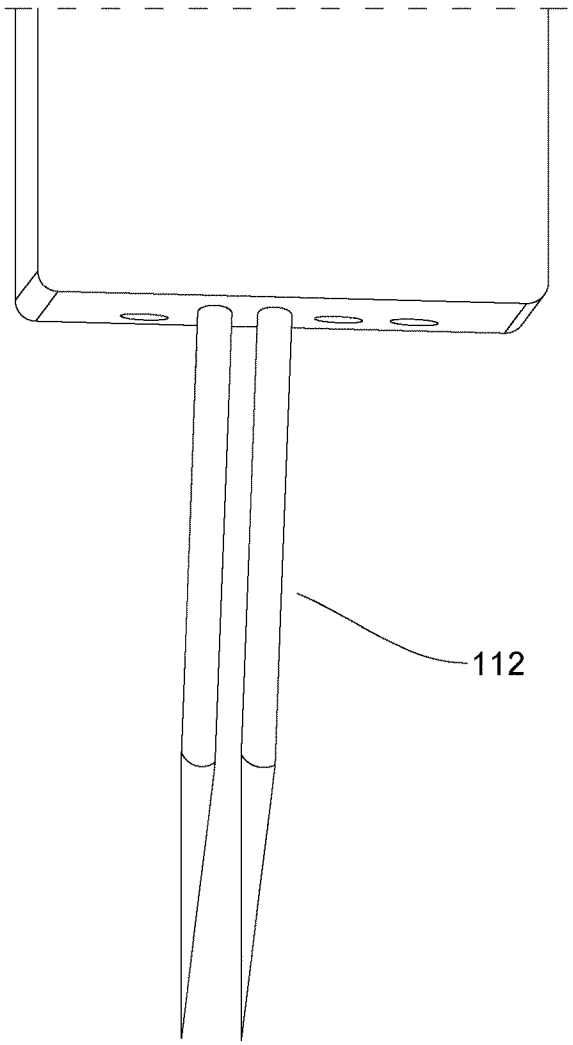
FIG. 7 is a representation of an injector needle in accordance with the disclosed subject matter.

With continued reference to FIG. 5, method 500 includes, at step 530, coupling the hair to the target location of the head form 108 via an injector needle. In various embodiments, the injector needle may be the same or similar to injector 112. In various embodiments, injector needle 112 may include two or more distinct needles disposed therein. The distinct needles may be disposed parallel to one another and oriented in the same direction, with a piercing tip configured to puncture the cap 108*b*, base layer 108*a* and head form in rapid succession over the target location, thus forcing hair through the cap 108*b* and into the base layer 108*a* as shown in FIG. 7.

Coupling hair to the target location may include positioning hair over the target location via the funnels 118 and shuttle 116. The funnels 118 may hold the ends of the hair over the target location on the head form 108, the injector needle 112 may then puncture the head form through the cap 108*b* and base layer 108*a* pushing the ends of the hair through and securing via the compression of the cap 108*b*. The injector needle 112 may reciprocate as it travels in an arcuate path over the target location of the head form 108, forcing the hair held by the funnels 118 through the cap 108*b* and base layer 108*a* underneath, depositing and coupling hair onto the cap 108*b*'s target location as it rotates and translates transversely relative to the cap. In various embodiments, the method 500 is repeated for a full wig, wherein the shuttle 116 retreats from the head form 108 after a row of hair is inserted via injector needle 112. The head form 108 then rotates to a new target location and the process is repeated.

In various embodiments, the cartridges may contain enough hair for a portion of a wig, for example one arcuate pass of the injector needle 112. In various embodiments, the cartridges 120 may contain enough hair to manufacture the entire wig. In various embodiments, the shuttle 116 may be removed from the track 124 and replaced with another shuttle 116 preloaded with cartridges 120 filled with hair ready to be injected. In various embodiments the cartridges 120 may be swapped out once empty of hair. In various embodiments, after each row of hair is injected into the cap 108*b*, the shuttle 116 may retreat and a nozzle may blow compressed air or another gas over the head form 108, thus blowing the newly injected hair away from the shuttle in order to prevent any hair form being ripped from the head form 108 if still inside the funnels 118 of the cartridges 120.

Any portion of the system and method described herein may be machine-controlled. For example, and without limitation, the method may be implemented by a computer program configured to control the machine described in reference to system 100, controlling the shuttle advancement and retreat, head form rotation and the needle operation.

Figure 8:
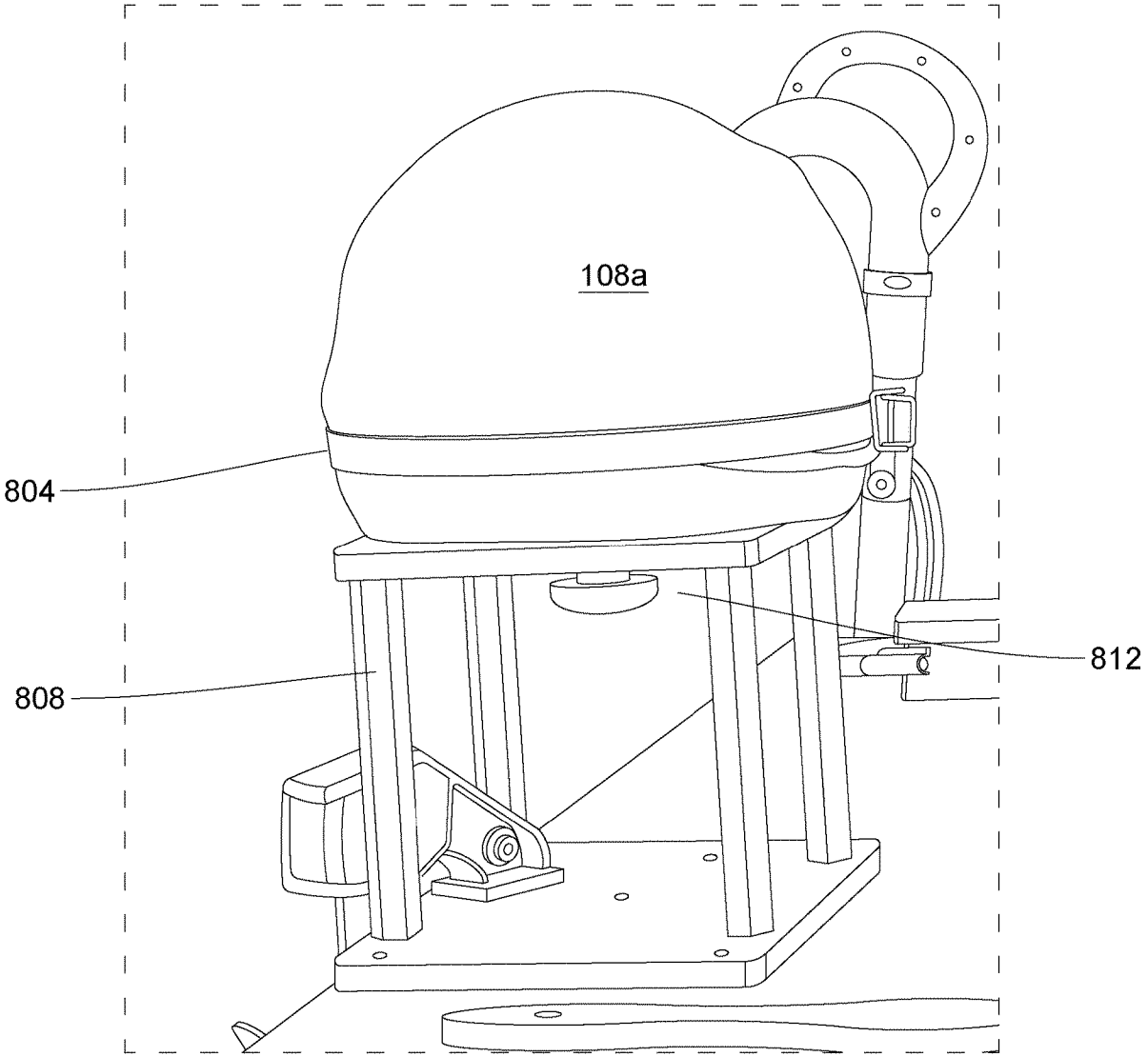
FIG. 8 is a representation of a cap removal fixture in accordance with the disclosed subject matter.

Referring now to FIG. 8, a cap 108*b* removal fixture is shown in a side perspective view. The cap 108*b* removal fixture may include one or more fasteners, such as the strap 804 configured to secure the base layer 108*a* while the fully-injected cap 108*b* is removed (not shown for clarity sake). In various embodiments, the strap 804 may be a ziptie, metal strap, ratchet strap, or any other suitable component capable of securing the base layer 108*a* for cap 108*b* removal. The cap 108*b* removal fixture may include a stand configured to hold a head form 108 up toward a user, where the head form 108 may be secured to the stand 808 via a threaded knob 812. Head form 108 may be removed from the system 100 after wig injection and secured to cap 108*b* removal fixture in the same manner the head form 108 was secured to rotating arm 104.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A system for the manufacture of a wig, the apparatus comprising:

a frame having a rotating arm spanning from a first side of the frame to a second side of the frame in a first direction;

a head form coupled to the rotating arm, the head form having a convex arcuate surface;

a shuttle slidingly coupled to the frame, the shuttle configured to slide in a second direction, the second direction being perpendicular to the first direction, the shuttle having an arcuate edge corresponding to the convex arcuate portion of the head form;

a plurality of funnels disposed about the arcuate edge of the shuttle, the funnels having an opening disposed therethrough, the plurality of funnels configured to contact the convex arcuate surface of the head form;

a plurality of cartridges coupled to the plurality of funnels;

an injector needle coupled to an injector arm, the injector arm configured to position the injector needle perpendicularly over the convex arcuate portion of the head form.

2. The system of claim 1, further comprising a nozzle coupled to the frame, the nozzle having at least one orifice and configured to eject a gas from the nozzle.

3. The system of claim 1, wherein the plurality of cartridges are rotatably coupled to the shuttle at a first end, the plurality of cartridges having a second end with a cylindrical sidewall extending therebetween, the plurality of cartridges having a hollow cavity extending therethrough.

4. The system of claim 1, wherein the plurality of cartridges are configured to be preloaded with hair.

5. The system of claim 1, wherein the plurality of cartridges are configured to be coupled to a vacuum component, the vacuum component configured to maneuver the hair into the cartridge under a pressure differential.

6. The system of claim 1, wherein the shuttle is configured to slide along a linear track, the linear track having a proximal end and a distal end, the distal end of the linear track disposed proximate the head form.

7. The system of claim 1, wherein the head form comprises contours corresponding to an upper portion of a human head.

8. The system of claim 1, wherein the injector needle is configured to couple the hair from the plurality of cartridges to the head form in arcuate rows parallel to the first direction.

9. The system of claim 1, wherein the head form comprises a base layer disposed over the convex arcuate surface, with a cap disposed over the base layer.

10. The system of claim 9, wherein the base layer is formed from silicone, the base layer configured to be stretched over the head form.

11. The system of claim 10, wherein the cap is formed from polyurethane and configured to stretch over the base layer.

12. The system of claim 1, wherein the plurality of cartridges are disposed in at least two rows along the arcuate edge of the shuttle.

13. The system of claim 1, wherein the plurality of funnels are configured to be automatedly reloaded with the plurality of cartridges.

14. The system of claim 1, wherein the arcuate edge of the shuttle is configured to correspondingly form to at least one contour of the head form.

* * * * *